US007855347B2

(12) United States Patent
Kato et al.

(10) Patent No.: US 7,855,347 B2
(45) Date of Patent: Dec. 21, 2010

(54) MEMBER FOR PUSH BUTTON SWITCH AND METHOD OF MANUFACTURING THE SAME

(75) Inventors: Katsuhiko Kato, Gumma (JP); Hitoshi Uchiyama, Saitama (JP)

(73) Assignee: Shin-Etsu Polymer Co., Ltd., Tokyo (JP)

( * ) Notice: Subject to any disclaimer, the term of this patent is extended or adjusted under 35 U.S.C. 154(b) by 298 days.

(21) Appl. No.: 12/092,639

(22) PCT Filed: Jun. 27, 2006

(86) PCT No.: PCT/JP2006/312822

§ 371 (c)(1),
(2), (4) Date: Jul. 25, 2008

(87) PCT Pub. No.: WO2007/055048

PCT Pub. Date: May 18, 2007

(65) Prior Publication Data

US 2009/0133997 A1 May 28, 2009

(30) Foreign Application Priority Data

Nov. 8, 2005 (JP) ..... 2005-323562
Mar. 2, 2006 (JP) ..... 2006-055956

(51) Int. Cl.
*H01H 9/18* (2006.01)

(52) U.S. Cl. ..... 200/341; 200/310; 200/314; 200/317; 29/622

(58) Field of Classification Search ..... 200/5 A, 200/511–517, 310, 314, 317, 341; 341/22, 341/28; 345/168–170, 173, 176; 29/622; 362/626, 85, 26, 30, 87
See application file for complete search history.

(56) References Cited

U.S. PATENT DOCUMENTS 6,977,352 B2 * 12/2005 Oosawa ..... 200/314
7,070,349 B2 * 7/2006 Dombrowski et al. ..... 400/490

(Continued)

FOREIGN PATENT DOCUMENTS

EP 1132932 A 9/2001

(Continued)

OTHER PUBLICATIONS

PCT International Search Report and Written Opinion, dated Jul. 25, 2006 in corresponding PCT Application No. PCT/JP2006/312822, Filed Jun. 27, 2006. (Three References identified in IDS were cited in PCT International Search Report).

*Primary Examiner*—Michael A Friedhofer
(74) *Attorney, Agent, or Firm*—Cowan, Liebowitz & Latman, P.C.; Mark Montague, Esq.

(57) ABSTRACT

To obtain a member for a push button switch having a natural metallic impression and an upscale impression; enabling a precise arrangement of the push buttons; being capable of being made thinner; and being difficult to get stained, there is provided a member for a push button switch having a configuration in which a gap between adjacent metal push buttons is filled with a transparent organic polymer material, the transparent organic polymer material including a transparent resin sheet extending from an interior surface of the gap to a ceiling surface side of the push button, and a transparent rubber-like elastic material disposed inside the transparent resin sheet.

21 Claims, 17 Drawing Sheets

U.S. PATENT DOCUMENTS

| | | | | |
|---|---|---|---|---|
| 7,119,296 | B1 * | 10/2006 | Liu et al. | 200/341 |
| 7,321,103 | B2 * | 1/2008 | Nakanishi et al. | 200/512 |
| 7,358,454 | B2 * | 4/2008 | Senzui | 200/341 |
| 7,404,682 | B2 * | 7/2008 | Dombrowski et al. | 400/490 |
| 7,449,642 | B1 * | 11/2008 | Wu et al. | 200/5 A |
| 7,465,889 | B2 * | 12/2008 | Nakajima et al. | 200/5 A |
| 7,488,910 | B2 * | 2/2009 | Hong | 200/310 |
| 7,503,683 | B2 * | 3/2009 | Liu | 362/616 |
| 7,523,544 | B2 * | 4/2009 | Hsu | 29/622 |
| 7,538,286 | B2 * | 5/2009 | Yoshioka | 200/341 |
| 7,586,056 | B2 * | 9/2009 | Nakayama et al. | 200/512 |
| 7,626,133 | B2 * | 12/2009 | Wu et al. | 200/341 |
| 7,663,071 | B2 * | 2/2010 | Chang | 200/345 |
| 7,671,290 | B2 * | 3/2010 | Chen et al. | 200/314 |
| 7,705,256 | B2 * | 4/2010 | Kenmochi | 200/314 |
| 7,705,259 | B2 * | 4/2010 | Kenmochi | 200/514 |

FOREIGN PATENT DOCUMENTS

| | | | |
|---|---|---|---|
| JP | 2003-129248 | A | 5/2003 |
| JP | 2005-190743 | A | 7/2005 |
| JP | 2005-251514 | A | 9/2005 |
| JP | 2006-156333 | A | 6/2006 |
| KR | 10-0454203 | B | 10/2004 |

* cited by examiner (a)

(b)

(a)

(b)

(a)

(b)

MEMBER FOR PUSH BUTTON SWITCH AND METHOD OF MANUFACTURING THE SAME

TECHNICAL FIELD

The present invention relates to a member for a push button switch used in a control panel of an electronic device and a method of manufacturing the same.

BACKGROUND ART

In the industry of members for push button switches used in control panels of electronic devices, particularly those of cellular phones, the diversifications for the design and function has further increased. In recent years, as a member for a push button switch used in the electronic device such as a cellular phone, a member having a metallic appearance is used as a high-end design. The member for a push button switch having a metallic appearance has the structure in which a plated layer, a resin molded portion, and a base rubber are layered in the stated order from the push button surface side. The plated layer is, for example, nickel-plated, copper-plated, or chrome-plated (for example, see Patent Document 1). Further, in order to protect the plated layer, a technology of forming a transparent resin coated layer on a surface of the plated layer is known. Also, there is known a member for a push button switch, in which a resin film subjected to metal evaporation is processed by drawing, and the interior thereof is filled with a core material formed of a resin or a rubber with the resin film being used as a outer layer to be integrated.

In order to further increase an upscale impression of electronic devices such as cellular phones, there is also known a member for a push button switch having a structure where a metal push button is attached to a surface of a flexible sheet such as a silicone rubber (for example, see Patent Document 2). Besides, considering the use in a dark place or designability, in this member for a push button switch, a hole having a shape such as a number is made in the push button itself and a transparent resin is fit into the hole. As a result, the number or the like is easily visible when exposed to light from a rear side of the push button.

In addition, the demands for making electronic devices such as cellular phones thinner are strong. Therefore, a member for a push button switch mounted onto an electronic device such as a cellular phone is required to become thinner as well.

Patent Document 1: JP 2003-129248 A (for example, Scope of Claims)

Patent Document 2: KR 100454203 B (for example, Scope of Claims)

However, the aforementioned member for a push button switch has the following problems. In the case where a member for a push button switch having metallic appearance is manufactured by forming a plated layer on a surface of a resin molded portion, the plated layer is liable to be peeled off, which makes it difficult to be used for a long period of time. Further, providing a metallic appearance through plating process results in poor productivity, which has a bad influence on the environment. In addition, though taking on a metallic-like texture to a certain extent, the member for a push button switch subjected to the plating process can hardly be provided with a natural metallic appearance. Also in the case of a resin push button having a metallic appearance, because the resin is used as a material, some extent of thickness is required for ensuring intensity. The aforementioned matter is an obstacle to the attempt to make a member for a push button switch thinner.

On the other hand, in the case where a metal push button is attached to a surface of a flexible sheet such as a silicone rubber, because the metal push button is used, the problems described above hardly occur. However, the step of accurately positioning each metal push button on a keypad to be bonded thereto is extremely complicated. Further, the flexible sheet such as a silicone rubber exists in a gap between the metal push buttons, and thus there arises a problem in that a friction coefficient becomes relatively large in the gap portion, and the gap is easy to get dirty or stained.

The present invention has been made in view of the above problems, and an object thereof is to provide a member for a push button switch which has a natural metallic impression and upscale impression, enables a precise arrangement of the push buttons, can be made thinner, and is difficult to get stained.

OBJECTS AND SUMMARY OF THE INVENTION

In order to achieve the aforementioned object, the present invention provides a member for a push button switch having a configuration where a gap between adjacent metal push buttons is filled with a transparent organic polymer material, in which the organic polymer material includes a transparent resin sheet extending from an interior surface of the gap to a ceiling surface side of the push button and a transparent rubber-like elastic material disposed inside the transparent resin sheet.

As described above, the push button is a member made of metal, there arises no problem such as a reduction in adhesion between a plated layer and a resin molded portion. Accordingly, a natural metallic impression can be attained. Further, use of the metal push button makes it possible to make the metal push button thinner with ease. Further, because the member for a push button switch according to the present invention has a structure where a gap between the adjacent metal push buttons is filled with the transparent rubber-like elastic material covered with the transparent resin sheet, the transparent resin sheet having a relatively small friction coefficient is provided on the gap which is placed between the adjacent metal push buttons. As a result, the gap is difficult to get stained or dusty. Further, the metal push buttons are not individually attached to an organic polymer material, and thus accurate arrangement of the push buttons is accomplished.

Further, another present invention provides, in the preceding invention, a member for a push button switch including a printing layer or a coloring layer at least in a portion extending toward the ceiling surface side of the metal push button in the transparent resin sheet. As a result, the function for the button can be indicated on the each metal push button. In particular, when light is irradiated from a rear side of the transparent rubber-like elastic material, the portion of the printing layer or the coloring layer can be identified even in a dark place, which facilitates the use in the dark place. In the case of the structure where a hole is provided in the metal push button and the transparent resin sheet can be seen, the printing layer or the coloring layer may be provided also on the rear side of the metal push button.

Further, still another present invention provides, in each of the preceding inventions, a member for a push button switch in which a surface of the metal push button is provided with irregularities or a hole to form a number, a symbol, a pattern, or a graphic. Since the irregularities or the hole is thus formed in the surface of the metal push button, there is an extremely low possibility that the number or the like made by the irregularities or the hole may be erased through an operation of the push button. The pattern formed by the irregularities or the hole can be formed by processing such as laser processing, press processing, etching, mat finish, and hairline finish. Also in the case where a hole is provided in the metal push button, when light is irradiated from the rear side of the push button, the portion of the pattern is easily visible. For this reason, in particular, the another invention is useful when an electronic device using the member for a push button switch is used in a dark place.

Further, yet another present invention provides, in each of the preceding inventions, a member for a push button switch having a light emitting member disposed between a surface opposite to the metal push button in the transparent rubber-like elastic material and a circuit board disposed therebelow. Thus, a gap between the adjacent push buttons can emit light. As a result, a position of each push button is easily visible, and the another present invention is easily used when an electronic device using the member for a push button switch is used also in a dark place. As the light emitting member, for example, an LED or EL sheet is preferably used.

Further, still another present invention provides, in each of the preceding inventions, a member for a push button switch having a configuration where a hole penetrating the metal push button in a direction into and out of the metal push button is formed to make the transparent organic polymer material extend from the hole to the top surface of the metal push button. For this reason, when light is irradiated from the rear side of the push button, it is getting easier to distinct the push button. Accordingly, in particular, the another invention is useful when an electronic device using the member for a push button switch is used in a dark place. In addition, because the hole is filled with the transparent organic polymer material, penetration of grit and dust from the outside can be prevented.

Further, still another present invention provides, in each of the preceding inventions, a member for a push button switch having a sheet provided with a presser for pressing a switch below the transparent rubber-like elastic material. The sheet provided with the presser is attached from the beginning in this way, and thus an electronic device such as a cellular phone is easily assembled.

Further, still another present invention provides, in each of the preceding inventions, a member for a push button switch in which the transparent organic polymer material is made to project from the surface of the metal push button. For this reason, compared with the case where the transparent organic polymer material is dented from the surface of the metal push button, accumulation of grit and dirt in the gap between the adjacent metal push buttons can be effectively prevented. Also in the case where the hole penetrating the metal push button itself is filled with the transparent organic polymer material, distinguishing the push button itself becomes easier. In addition, compared with the case where the transparent organic polymer material is dented from the surface of the metal push button, accumulation of grit and dirt in the portion of the transparent organic polymer material filled in the penetrating hole can be effectively prevented. Here, in the case where the surface of the push button is not a planar shape, the description "project from the surface of the metal push button" means that the transparent organic polymer material projects from the surface portion of the metal push button located on an outer edge of the transparent organic polymer material. Accordingly, even in the case where a transparent organic polymer material located in the gap between the adjacent metal push buttons is lower than a top portion of a metal push button which has a convex-shaped center, the height of the transparent organic polymer material projects from the surface of the metal push button if being higher than a periphery of the push button.

Further, still another present invention provides a method of manufacturing a member for a push button switch having a configuration in which a gap between adjacent metal push buttons is filled with a transparent organic polymer material, the method including the steps of: attaching a transparent resin sheet to one surface of a metal plate; forming a hole by performing etching from a surface opposite to the one surface having the transparent resin sheet attached thereto in the metal plate to the transparent resin sheet; and filling the hole with a transparent rubber-like elastic material coated with the transparent resin sheet by injecting the transparent rubber-like elastic material from an outer of the transparent resin sheet toward the hole.

In this manner, because the hole is made also from one surface of the metal plate to the resin sheet attached to the surface opposite thereto, even in the case of a member for a push button switch having a configuration where each push button is separated, the member for a push button switch can be manufactured without separating the metal plate for each push button. Accordingly, a position of the push button exclusively depends on accuracy in the step of drawing a region which is to be etched. Thus, compared with the step of attaching each push button, a push button can be arranged more easily as well as accurately. Further, with the use of a injection pressure of the transparent rubber-like elastic material, the transparent resin sheet is pushed into the hole, and thus the transparent resin sheet and the transparent rubber-like elastic material do not need to be filled separately. Consequently, the manufacturing step can be simplified.

Further, still another present invention provides a method of manufacturing a member for a push button switch having a configuration in which a gap between adjacent metal push buttons is filled with a transparent organic polymer material, the method including the steps of: forming a concave portion by performing etching from one side of a metal plate to a halfway position of a thickness of the metal plate; attaching a transparent resin sheet to the metal plate so as to close the concave portion of the one side; forming a hole connected to the concave portion formed in advance by performing etching from a surface opposite to the surface where the transparent resin sheet is attached; and filling the hole with a transparent rubber-like elastic material coated with the transparent resin sheet by injecting the transparent rubber-like elastic material from an outer of the transparent resin sheet toward the hole.

In this manner, the metal plate is etched from both sides thereof and the hole connected to the concave portion in a predetermined position having the thickness of the metal plate, whereby an edge portion of the hole provided on the both sides of the metal plate is easy to be formed clearly. Accordingly, the push button can be processed into an accurate shape. Further, as in the case of the manufacturing method described above, even in the case of a member for a push button switch having a configuration where each push button is separated, the member for a push button switch can be manufactured without separating the metal plate for each push button. Accordingly, a position of the push button exclusively depends on accuracy in the step of drawing a region which is to be etched. Thus, compared with the step of attaching each push button, the push button can be arranged easily as well as accurately.

Further, with the use of a injection pressure of the transparent rubber-like elastic material, the transparent resin sheet is pushed into a hole, and thus the transparent resin sheet and the transparent rubber-like elastic material do not need to be filled separately. As a result, the manufacturing step can be simplified.

Further, still another present invention provides, in each of the preceding inventions, a method of manufacturing a member for a push button switch further including the step of forming a printing layer or a coloring layer at least in a portion extending toward a ceiling surface side of the metal push button in the transparent resin sheet. Adopting of such a manufacturing method enables to indicate a function of each metal push button. In particular, when light is irradiated from a rear side of the transparent rubber-like elastic material, a portion of the printing layer or the coloring layer can be identified even in a dark place, whereby a member for a push button switch of an electronic device, which is easily used in the dark place, can be manufactured. Further, in the case where a hole is provided in the metal push button such that the transparent resin sheet is seen, the printing layer or the coloring layer may be provided also in a rear side of the metal push button.

Further, still another present invention provides, in each of the preceding inventions, a method of manufacturing a member for a push button switch further including the step of forming a number, a symbol, a pattern, or a graphic by providing irregularities or a hole on a surface of the metal push button. In this manner, the step of forming irregularities or a hole on the surface of the metal push button is used, so there can be manufactured a member for a push button switch with an extremely low possibility that the number or the like made by the irregularities or the hole disappears through an operation of the push button. The pattern formed by the irregularities or the hole can be formed by process such as laser processing, press processing, etching, mat finish, and hairline finish. Further, in the case where a hole is made in the metal push button, when light is irradiated from the rear side of the push button, the portion of the pattern is easily visible. As a result, in particular, a member for a push button switch of an electronic device, which is easily used in a dark place, can be manufactured.

Further, still another present invention provides, in each of the preceding inventions, a method of manufacturing a member for a push button switch further including the step of disposing a light emitting member between a surface opposite to the metal push button in the transparent rubber-like elastic material and a circuit board disposed therebelow. Adopting of such a manufacturing method makes the gap between the push buttons emit light. As a result, a position of each push button is easily visible, and a member for a push button switch of an electronic device, which is easily used in a dark place, can be manufactured. As the light emitting member, for example, an LED or EL sheet can be preferably used.

Further, still another present invention provides, in each of the preceding inventions, a method of manufacturing a member for a push button switch further including the step of forming a hole penetrating the metal push button in a direction into and out of the metal push button, in which, in the step of filling with the transparent rubber-like elastic material, the transparent organic polymer material is made to extend from the hole to a ceiling surface side of the metal push button. When such a manufacturing method is adopted, irradiation of light from the rear side of the push button makes it possible to easily distinguish push buttons. For this reason, in particular, the another present invention is useful when an electronic device using the member for a push button switch is used in a dark place. In addition, because the hole is filled with the transparent organic polymer material, penetration of grit and dirt can be prevented.

Further, still another present invention provides, in each of the preceding inventions, a method of manufacturing a member for a push button switch further including the step of providing a sheet provided with a presser for pressing a switch below the transparent rubber-like elastic material. Accordingly, an electronic device such as a cellular phone can be assembled with more ease using the member for a push button switch obtained through this manufacturing method.

Further, still another present invention provides, in each of the preceding inventions, a method of manufacturing a member for a push button switch, in which, in the step of filling with the transparent rubber-like elastic material, the transparent organic polymer material is made to project from a surface of the metal push button. Adopting of such a manufacturing method makes it possible to effectively prevent accumulation of grit and dirt in the gap between the metal push buttons, compared with the case where the transparent organic polymer material is dented from the surface of the metal push button. Also in the case where the hole penetrating the metal push button itself is filled with the transparent organic polymer material, the push button itself is easily distinguished. Moreover, compared with the case where the transparent organic polymer material is dented from the surface of the metal push button, a portion of the transparent organic polymer material filled into the penetrating hole can be effectively prevented from being filled with grit and dirt.

As a member of the metal push button forming the member for a push button switch according to the present invention, in addition to stainless steel, aluminum, magnesium, copper, zinc, titanium, or their alloy is preferably used, and in particular, stainless steel member is more preferably used. However, the aforementioned metals are cited as an example, and other metal material may be used.

Further, the material of the transparent organic polymer material forming the member for a push button switch according to the present invention includes the transparent resin sheet and the transparent rubber-like elastic material. As a material of the transparent resin sheet, in addition to PET, a transparent resin abundant in extendibility, such as urethane, polycarbonate, polystyrene, or polyester resin, may be used. Further, a silicone rubber is particularly preferable as the material of the transparent rubber-like elastic material. However, the transparent rubber-like elastic material is not limited to the silicone rubber, and for example, a urethane rubber may be used as other transparent rubber-like elastic material. It is assumed that the term "transparent" referred to in the present invention broadly includes "transparent and colorless", "transparent and colored", and "semitransparent".

The metal push buttons may be in a state of being separated each other or a state where a plurality thereof are gathered. Moreover, the push buttons may be not in a state of being completely separated, but in a state where a part of a circumference of each of the push buttons may be notched to connect to another push button.

According to the present invention, there can be provided the member for a push button switch, which has a natural metallic impression and an upscale impression; enables a precise arrangement of the push buttons; can be made thinner; and is difficult to get stained.

DESCRIPTION OF SYMBOLS

Figure 1:
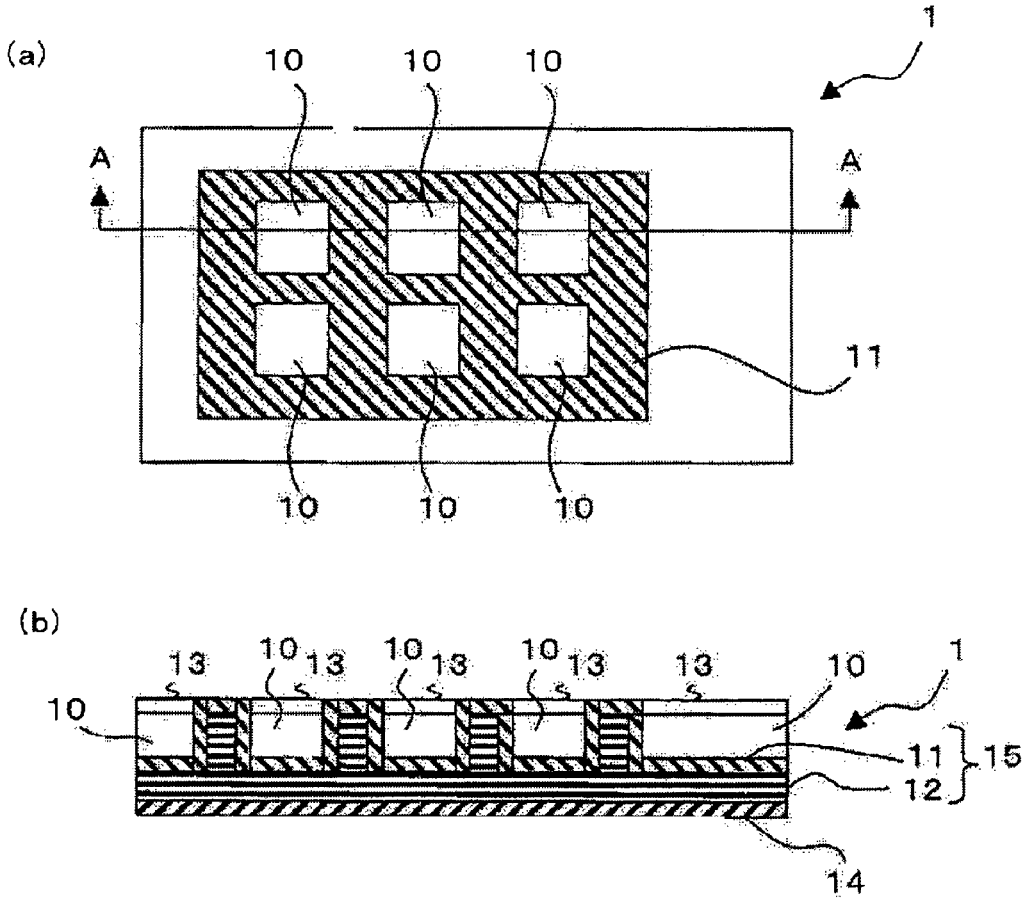
FIGS. 1(*a*) and 1(*b*) are views in which FIG. 1(*a*) is a plan view of a member for a push button switch according to a first embodiment of the present invention, and FIG. 1(*b*) is a cross-sectional view taken along the line A-A of the plane view of FIG. 1(*a*).

1 member for push button switch
10 metal push button
10*a* metal plate
11 transparent resin sheet
12 transparent rubber-like elastic material
12*a* presser
13 transparent resin coated layer
14 light emitting member
15 transparent organic polymer material
16 pusher sheet (sheet)
16*a* presser
20 hole
21 concave portion
25 printing layer, coloring layer
30 member for push button switch
40 member for push button switch
50 member for push button switch
60 member for push button switch
61 substrate
62 fixed contact (switch)
63 fixed contact (switch)
64 metal disc spring
70 member for push button switch
80 member for push button switch
90 member for push button switch

DETAILED DESCRIPTION OF THE INVENTION

Hereinafter, each preferable embodiment of a member for a push button switch according to the present invention and a method of manufacturing the same is described in detail with reference to the drawings. In each embodiment, a description is made on an example where the member for a push button switch is used as an operating unit of a cellular phone by way of example. However, the present invention is not limited to each embodiment described below, and is applicable to an operating unit of an electronic device other than the cellular phone, such as a laptop computer and an electronic notebook.

First Embodiment

Figure 2:
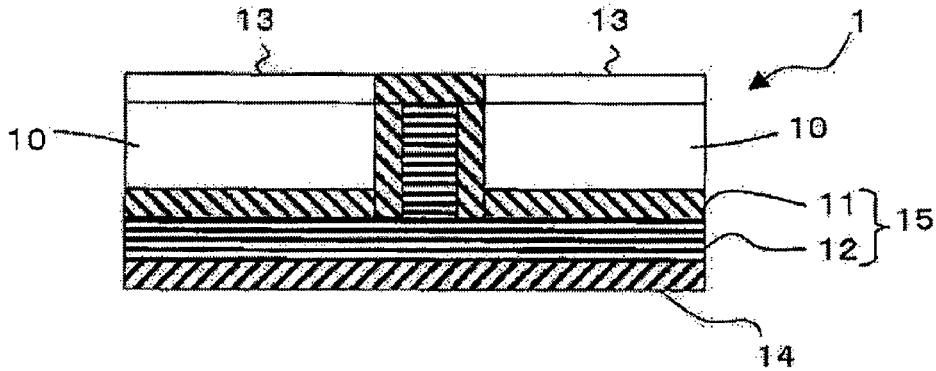
FIG. 2 is a partially enlarged view of FIG. 1(*b*) which is the cross-sectional view taken along the line A-A of FIG. 1(*a*).

FIGS. 1(*a*) and 1(*b*) include a plan view (a) of a member for a push button switch according to a first embodiment of the present invention, and a cross-sectional view (b) taken along the line A-A of FIG. 1(*a*). FIG. 2 is a partially enlarged view of the cross-sectional view (b) taken along the line A-A.

A member for a push button switch 1 mainly includes a plurality of metal push buttons 10, a transparent organic polymer material 15 (including a transparent resin sheet 11 and a transparent rubber-like elastic material 12) disposed to fill a gap between the adjacent metal push buttons 10, a transparent resin coated layer 13 applied on a surface of each metal push button 10, and a light emitting member 14 disposed on a rear side (side opposite to the metal push button 10) of the transparent organic polymer material 15.

The metal push button 10 is an operating part in the member for a push button switch 1, which can be pushed. On an operating surface of the metal push button 10, patterns of both a number and an alphabet are formed in a concave shape by pressing. Note that the pattern formed on the operating surface may be a pattern other than the number and the alphabet (for example, symbol or graphic), and may be formed through a processing method such as laser processing, etching, mat finish, and hairline finish. Also, as a material of the metal push button 10, stainless steel is used. However, aluminum, magnesium, copper, zinc, titanium, or a various alloy can also be used. Note that a thickness of a metal plate 10*a* for forming the metal push button 10 is preferably within a range of equal to or more than 0.1 mm to equal to or less than 0.5 mm, and more preferably within a range of equal to or more than 0.15 mm to equal to or less than 0.25 mm. In case the thickness is in such a range, deformation due to operation is difficult to appear, and also the demands of decreasing the thickness are met. However, the thickness of the metal plate 10*a* is not limited to the above-mentioned range, and may be set to less than 0.1 mm or more than 0.5 mm.

For the transparent resin coated layer 13 formed on the operating surface of the metal push button 10, in addition to a transparent synthetic resin such as an acrylic, polycarbonate, epoxy, oxetane synthetic resin having a high hardness, a transparent synthetic resin such as urethane or fluorinated synthetic resin having a lower hardness than the transparent synthetic resin having high hardness may be used. In the case where there is aimed a prevention of injuries caused by a touch during the operation and a contact with a metal burr or the like while maintaining a metallic appearance of the metal push button 10, as the transparent resin coated layer 13, in particular, using a resin paint is more preferable. However, the aforementioned resin paint is just an example, and other resin paint having high hardness may be used. Note that the transparent resin coated layer 13 is not an essential layer. Through selection of a metal type, a processing which does not cause a burr or the like, if a touch during the operation is good and there is a low possibility of the danger of injuries, the transparent resin coated layer 13 may not be formed.

The transparent resin sheet 11 forming the transparent organic polymer material 15 is a transparent sheet-like resin having extendibility, and, for example, is an organic polymer chemical compound such as polyethylene terephthalate (PET), polybutylene terephthalate (PBT), polycarbonate (PC), and urethane, or their compound. For example, because being excellent in drawing characteristics, an alloy of PC and PBT can be preferably used. Further, the transparent rubber-like elastic material 12 forming the transparent organic polymer material 15 is, for example, a silicone rubber or a urethane rubber. However, as the transparent rubber-like elastic material 12, other material (for example, thermoplastic elastomer) may be used. A thickness of the transparent resin sheet 11 is preferably within a range of equal to or more than 0.03 mm to equal to or less than 0.2 mm, and more preferably within a range of equal to or more than 0.05 mm to equal to or less than 0.1 mm. As described later, this is because the transparent resin sheet 11 smoothly extends to the gap between the adjacent metal push buttons 10 without making a hole by filling with the transparent rubber-like elastic material 12. However, the thickness of the transparent resin sheet 11 may be set to less than 0.03 mm or more than 0.2 mm.

As shown in FIG. 1(*b*), the transparent resin sheet 11 is arranged to cover a periphery of the transparent rubber-like elastic material 12 in the gap between the metal push buttons 10, so the transparent rubber-like elastic material 12 is not exposed to the operating surface side of the metal push button 10. Accordingly, it is difficult to get stained or dusty on the gap between the metal push buttons 10. Moreover, the member for a push button switch 1 is structured so that the metal push button 10 is substantially flush with the transparent resin sheet 11 disposed in the gap between the adjacent push buttons 10. As a result, further, grit and dirt hardly adhere to the gap between the adjacent metal push buttons 10.

Further, the light emitting member 14 is disposed between the transparent rubber-like elastic material 12 and a circuit board (not shown) arranged therebelow. As the light emitting member 14, an EL sheet can be preferably used. However, the light emitting member 14 (for example, LED) other than the EL sheet may be used. In this manner, when the light emitting member 14 is arranged below the transparent rubber-like elastic material 12, the transparent resin sheet 11 can emit light through light emission of the light emitting member 14. Therefore, even in a dark place, the member for a push button switch 1 can be easily operated.

Further, when a hole is made in the operating surface of the metal push button 10 to indicate a function (for example, number and alphabet) of each metal push button 10, in the case of making the light emitting member 14 emit light, light in a shape corresponding to a shape of the hole is visible on the operating surface side through the transparent rubber-like elastic material 12, the transparent resin sheet 11, and the hole. For this reason, each metal push button 10 can be used more easily in a dark place. Note that, without making a hole, the concave portion is formed with the almost full depth from the operating surface of the metal push button 10 to the surface opposed thereto and a bottom of the concave portion is made thinner than other regions, whereby light can be made to pass corresponding to the shape of the concave portion. In the case where the concave portion is formed, there can be obtained an effect that each metal push button 10 can be used much more easily in a dark place.

Next, a description is made on an example of a method of manufacturing the member for a push button switch 1 according to the first embodiment of the present invention.

Figure 3:
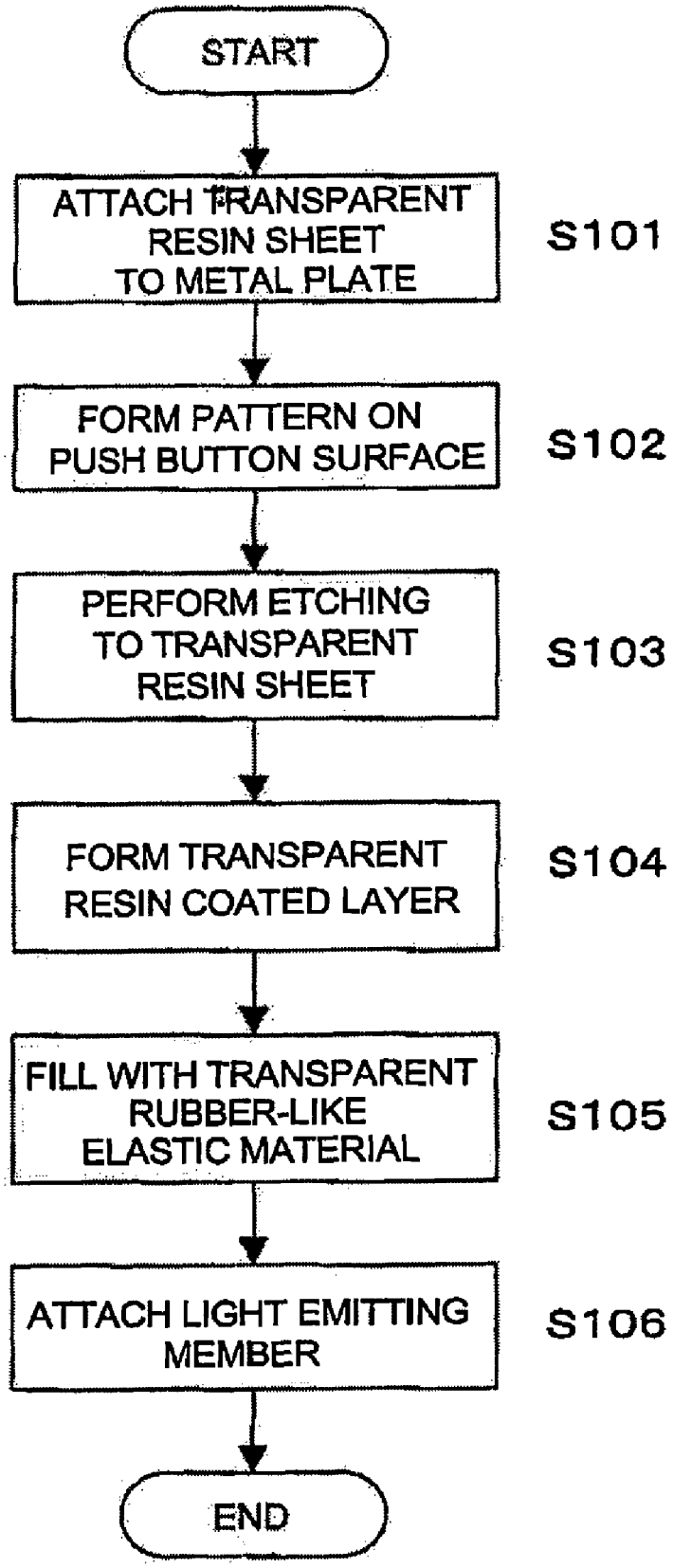
FIG. 3 is a flowchart showing an example of a method of manufacturing the member for a push button switch according to the first embodiment of the present invention.
Figure 4:
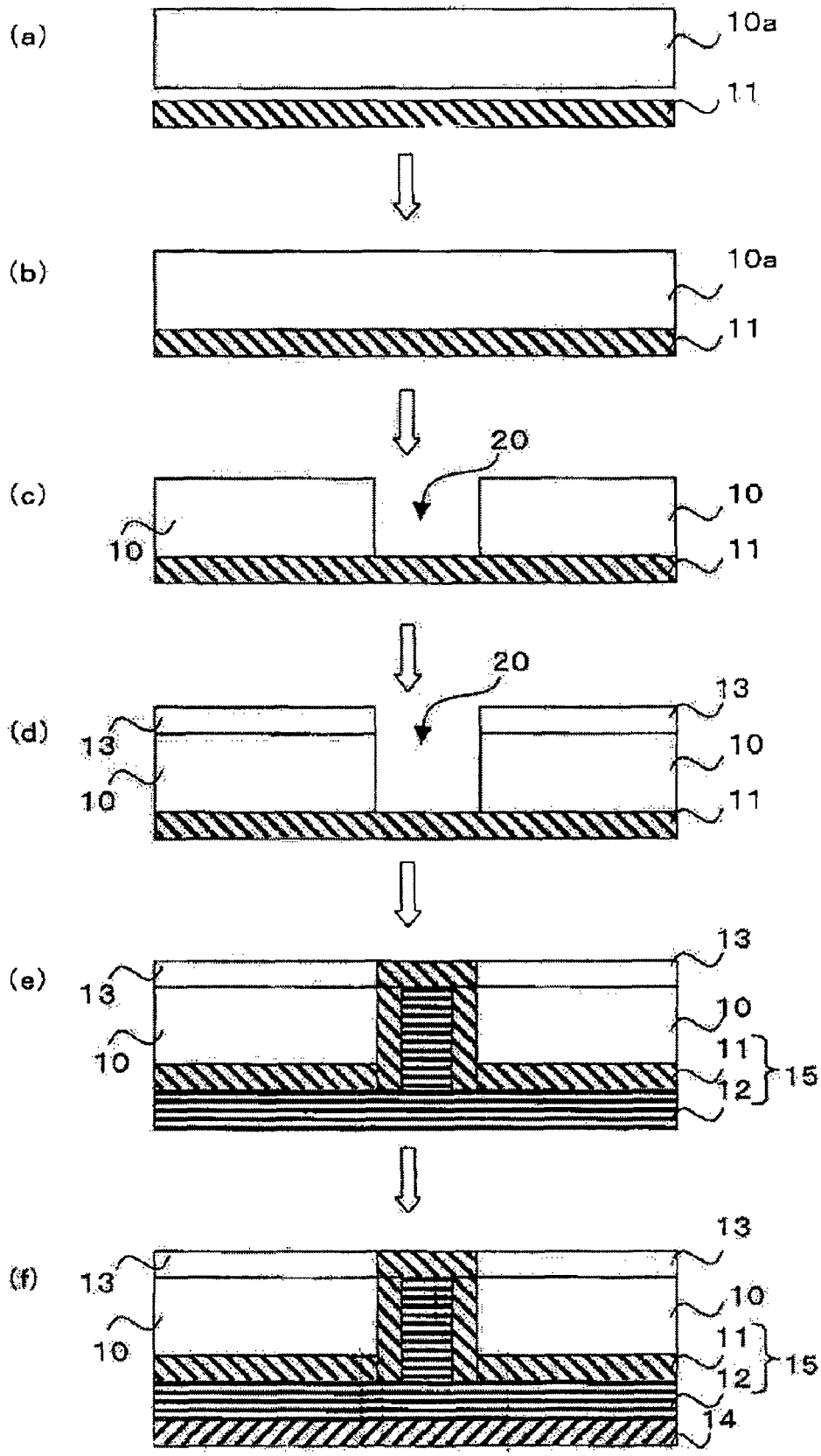
FIGS. 4(*a*) through 4(*f*) are views showing a state in each step of manufacturing the member for a push button switch according to the first embodiment of the present invention.

FIG. 3 is a flowchart showing an example of the method of manufacturing the member for a push button switch 1 according to the first embodiment of the present invention. FIGS. 4(*a*) through 4(*f*) are views showing a state in each step of manufacturing the member for a push button switch 1 according to the first embodiment.

First, the transparent resin sheet 11 is attached to one surface side of the metal plate 10*a* in a state before processing the metal push button 10 (Step S101). In this attachment, although a thermosetting adhesive which demonstrates an adhesive function by heat is preferably used, a double-sided tape and an adhesive capable of becoming cured at room temperature may be used. Through this Step S101, the member for a push button switch 1 becomes the state shown in FIG. 4(*b*) from the state shown in FIG. 4(*a*). Next, on a surface which becomes a push button on the opposite side of the surface to which the transparent resin sheet 11 in the metal plate 10*a* is attached, a pattern is formed by press (Step S102).

Next, until reaching the transparent resin sheet 11, the metal plate 10*a* is etched (Step S103). As a result, a hole 20 is formed. Through this Step S103, the member for a push button switch 1 becomes the state shown in FIG. 4(*c*) from the state shown in FIG. 4(*b*). In this embodiment, a photo-etching is used as an etching method having merits such as design freedom, excellent processing accuracy, and low initial cost. Note that, as a method of forming the hole 20 other than the photo-etching, for example, a machining process using a tool for high-precision processing may be used.

Next, the transparent resin coated layer 13 is formed on the surface of the metal push button 10 (Step S104). This step is conducted, for example, by a method such as spray, coat, and paint. This step is conducted to bring the transparent resin coated layer 13 into contact with the metal push button 10, to prevent hand injuries caused by a contact with a burr or the like generated in the metal push button 10, and to prevent a touch feeling from being deteriorated. Also, this step is conducted to prevent the pattern formed on the operating surface of the metal push button 10 from getting stained. Through this Step S104, the member for a push button switch 1 becomes the state shown in FIG. 4(*d*) from the state shown in FIG. 4(*c*).

Next, the transparent rubber-like elastic material 12 is filled at high pressure from the side where the transparent resin sheet 11 is attached toward the hole 20 (Step S105). As a result, the transparent rubber-like elastic material 12 is filled in the hole 20 while pushing the transparent resin sheet 11 to the hole 20. It is preferable that a pressure during filling the transparent rubber-like elastic material 12 be made equal to or less than 200 kgf/cm$^2$, and a temperature during the filling be within a range of 100 to 180° C. However, the pressure and the temperature are both not limited to the aforementioned range, and can be arbitrarily changed according to the various conditions such as a material of the transparent resin sheet 11 and the transparent rubber-like elastic material 12. Through this Step S105, the member for a push button switch 1 becomes the state shown in FIG. 4(*e*) from the state shown in FIG. 4(*d*). In other words, the transparent resin sheet 11 is extended from a rear surface of the metal push button 10 along an inner surface of the gap so as to form a top surface of the gap. Further, the transparent rubber-like elastic material 12 exists from the rear side of the transparent resin sheet 11 to the rear side of the metal push button 10.

Next, the light emitting member 14 is attached from a rear side of the transparent rubber-like elastic material 12 (Step S106). As an attaching method, an adhesive, a double-sided tape, or the like is preferably used. Through this Step S106, the member for a push button switch 1 becomes the state shown in FIG. 4(*f*) from the state shown in FIG. 4(*e*).

Second Embodiment

Next, a description is made on the member for a push button switch according to the present invention and a method of manufacturing the same according to the second embodiment.

The member for a push button switch according to the second embodiment has the same structure as that of the member for a push button switch 1 according to the first embodiment described above. Thus, also in the member for a push button switch according to the second embodiment, the same symbols as those in the member for a push button switch 1 according to the first embodiment are used. Also, because component parts composing the member for a push button switch 1 according to the second embodiment is the same as component parts composing the member for a push button switch 1 according to the first embodiment, the same symbols are used and the description overlapping the first embodiment is omitted.

Figure 5:
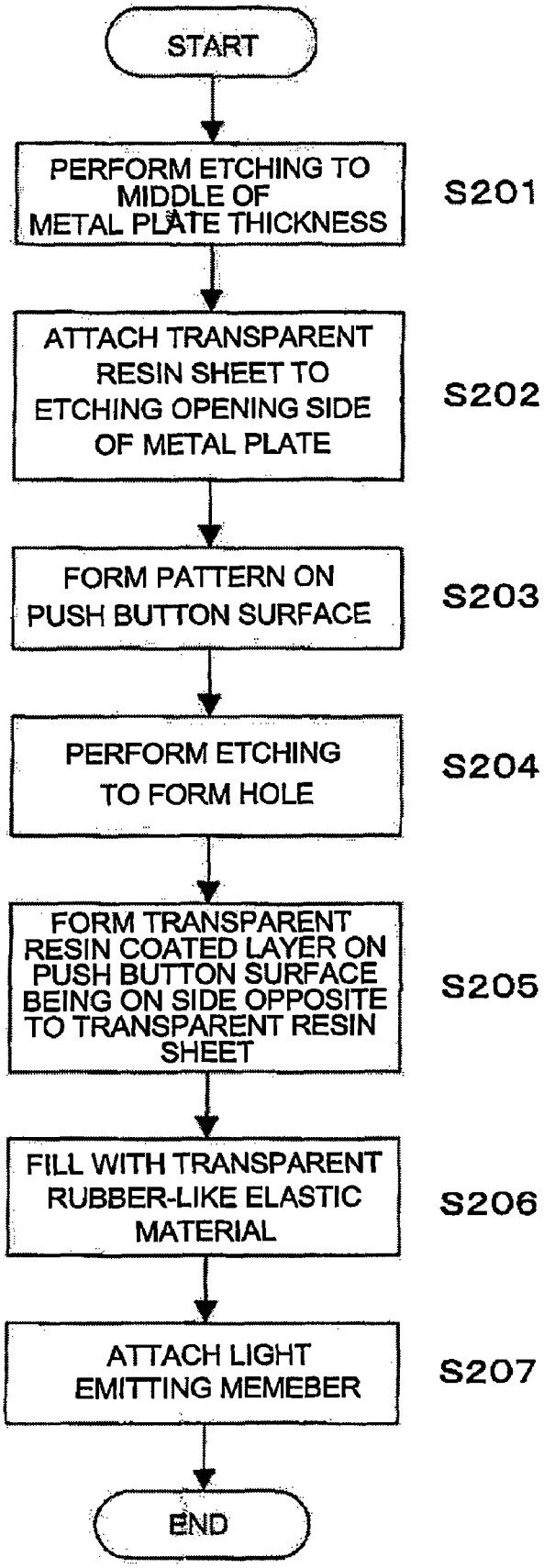
FIG. 5 is a flowchart showing an example of a method of manufacturing a member for a push button switch according to a second embodiment of the present invention.
Figure 6:
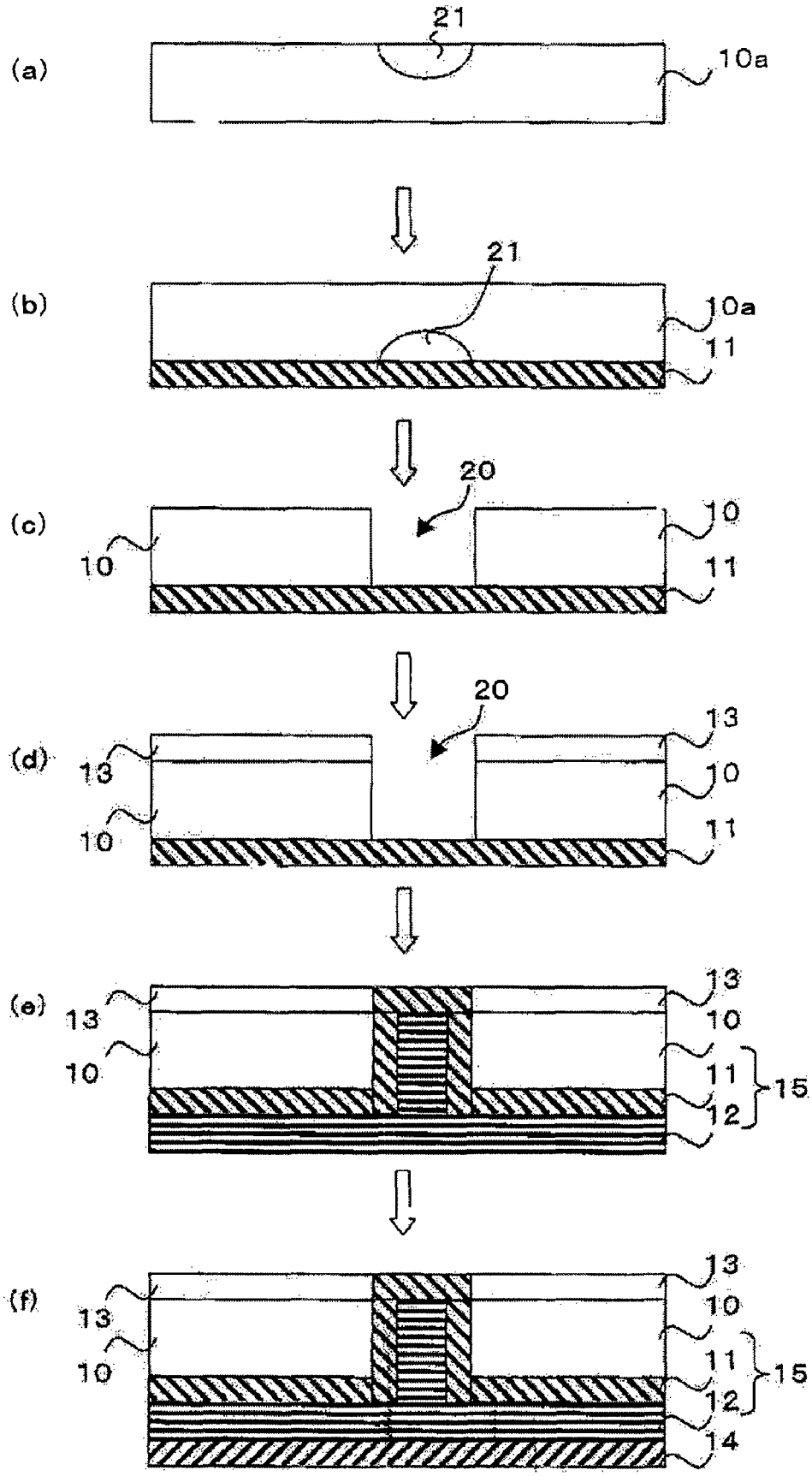
FIGS. 6(*a*) through 6(*f*) are views showing a state in each step of manufacturing the member for a push button switch according to the second embodiment of the present invention.

FIG. 5 is a flowchart showing an example of the method of manufacturing the member for a push button switch 1 according to the second embodiment. FIGS. 6(*a*) through 6(*f*) are views showing a state in each step of manufacturing the member for a push button switch 1 according to the second embodiment.

First, from one surface side of the metal plate 10*a*, etching is performed to the middle of a thickness of the metal plate 10*a* to form a concave portion 21 (Step S201). In the etching, as in the case of the first embodiment, a photo-etching is preferably used. Through Step S201, the member for a push button switch 1 becomes the state shown in FIG. 6(*a*).

Next, the transparent resin sheet 11 is attached to a surface of an opening side of the concave portion 21 in the metal plate 10*a* (Step S202). In this attachment, although a thermosetting adhesive which demonstrates an adhesive function by heat is preferably used, a double-sided tape or an adhesive capable of becoming cured at room temperature may be used. Through this Step S202, the member for a push button switch 1 becomes the state shown in FIG. 6(*b*) from the state shown in FIG. 6(*a*). Next, on a surface which becomes a push button on the opposite side of the surface to which the transparent resin sheet 11 in the metal plate 10*a* is attached, a pattern is formed by press (Step S203).

Next, etching is performed from a side opposite to the opening side of the concave portion 21 to form the hole 20 connecting with the concave portion 21 (Step S204). Through this Step S204, the member for a push button switch 1 becomes the state shown in FIG. 6(*c*) from the state shown in FIG. 6(*b*).

Next, the transparent resin coated layer 13 is formed on the side opposite to the surface having the transparent resin sheet 11 attached in the metal push button 10 (Step S205). Through this Step S205, the member for a push button switch 1 becomes the state shown in FIG. 6(*d*) from the state shown in FIG. 6(*c*).

Next, the transparent rubber-like elastic material 12 is filled from a side where the transparent resin sheet 11 is attached toward the hole 20 at high pressure (Step S206). As a result, the transparent rubber-like elastic material 12 is filled in the hole 20 while pushing the transparent resin sheet 11 to the hole 20. Through this Step S206, the member for a push button switch 1 becomes the state shown in FIG. 6(*e*) from the state shown in FIG. 6(*d*). In other words, the transparent resin sheet 11 is extended from a rear surface of the metal push button 10 along an inner surface of the gap so as to form a top surface of the gap. Further, the transparent rubber-like elastic material 12 exists from a rear side of the transparent resin sheet 11 to the rear side of the metal push button 10.

Next, the light emitting member 14 is attached from the rear side of the transparent rubber-like elastic material 12 (Step S207). Through this Step S207, the member for a push button switch 1 becomes the state shown in FIG. 6(*f*) from the state shown in FIG. 6(*e*).

Figure 7:
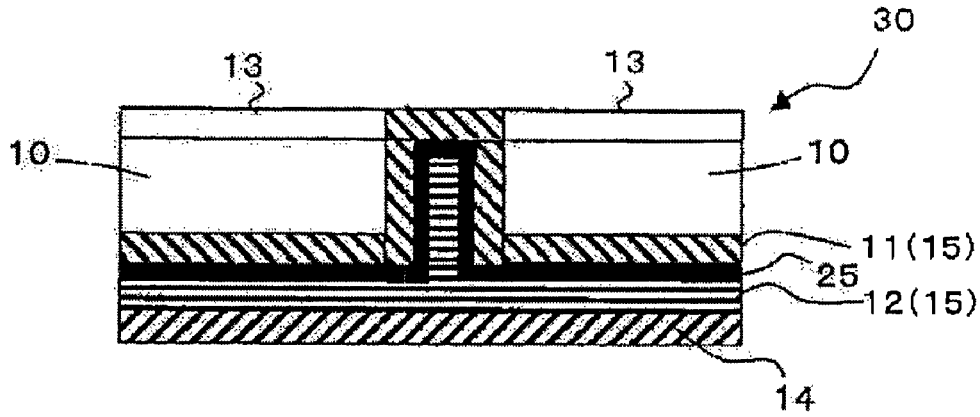
FIGS. 7(*a*) and 7(*b*) are partially enlarged views of a cross-sectional view when a member for a push button switch according to a third embodiment of the present invention is cut by the same line as the line A-A of FIG. 1(*a*), in which FIG. 7(*a*) shows an example where a transparent resin coated layer formed on a surface of a metal push button is flush with a transparent organic polymer material, and FIG. 7(*b*) shows an example where the transparent organic polymer material projects from the transparent resin coated layer toward a surface side.
Figure 7:
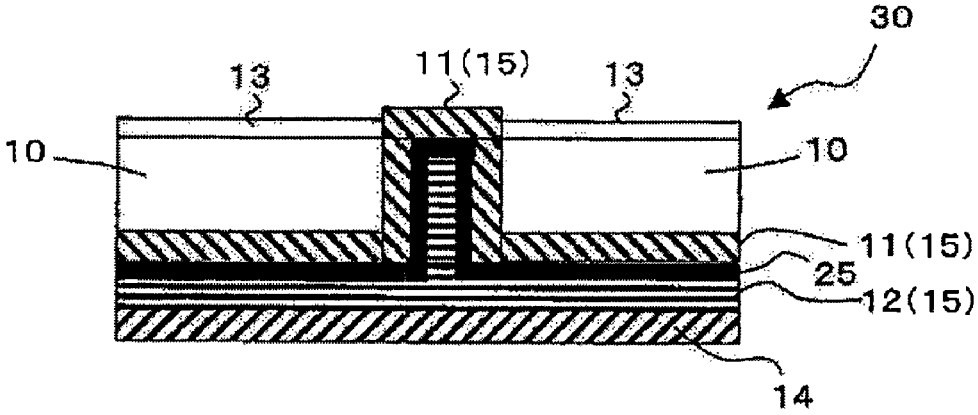

When the manufacturing steps shown in FIGS. 6(*a*) through 6(*f*) and FIGS. 7(*a*) and 7(*b*) are used, the transparent resin sheet 11 is hardly to be damaged during etching. In other words, after the formation of the concave portion 21, etching can be performed from the side opposite to the opening surface of the concave portion 21 and can be stopped at a time when connecting with the concave portion 21, whereby the transparent resin sheet 11 is hardly to be damaged by etching. Further, etching is performed from the both sides of the metal plate 10*a* to form the hole 20. Accordingly, an edge is easily formed on the both opening portions of the hole 20, and an edge of the metal push button 10 is easily made. Thus, when the transparent organic polymer material 15 is filled, an interface between the metal push button 10 and the transparent organic polymer material 15 becomes clear.

Third Embodiment

Next, a description is made on the member for a push button switch according to the present invention and a method of manufacturing the same according to the third embodiment.

A member for a push button switch 30 according to the third embodiment has component parts common to the member for a push button switch 1 according to the first embodiment described above. Thus, the same symbols are used in the component parts which are common to the member for a push button switch 30 according to the third embodiment and the member for a push button switch 1 according to the first embodiment, and an overlapping description is omitted.

FIGS. 7(*a*) and 7(*b*) are partially enlarged views of a cross-sectional view when the member for a push button switch 30 according to the third embodiment is taken along the line similar to the line A-A of FIG. 1(*a*). FIG. 7(*a*) shows an example in a state where the transparent resin coated layer 13 formed on the surface of the metal push button 10 is flush with the transparent organic polymer material 15, and FIG. 7(*b*) shows an example in a state where the transparent organic polymer material 15 projects from the transparent resin coated layer 13 toward a surface side.

As apparent from the comparison of FIGS. 7(*a*) and 7(*b*) and FIG. 2, the member for a push button switch 30 according to the third embodiment is different from the member for a push button switch 1 according to the first embodiment in that a printing layer 25 or a coloring layer 25 (hereinafter, referred to as "printing layer or the like" 25) exists between the transparent resin sheet 11 and the transparent rubber-like elastic material 12. In FIGS. 7(*a*) and 7(*b*), the printing layer or the like 25 is represented by a black heavy line. Further, the member for a push button switch 30 according to the third embodiment is different from the member for a push button switch 1 according to the first embodiment in that a urethane resin is used as the transparent resin sheet 11.

The printing layer or the like 25 may be formed in advance in the transparent resin sheet 11 or the transparent rubber-like elastic material 12, and may be formed separately before or after attaching the transparent resin sheet 11 to the metal plate 10*a*. In the latter case, the formation step of the printing layer or the like 25 is preferably performed before Step S202 or between Step S202 and Step S206 of FIG. 5. The printing layer or the like 25 is formed so that printing or coloring is visible from a surface side of the member for a push button switch 30 through irradiation of light from the rear side of the transparent rubber-like elastic material 12. As a specific formation method of the printing layer or the like 25, for example, there can be included a method of converting a desired design to data by a CAD system to make a drawing on the transparent resin sheet 11 or the transparent rubber-like elastic material 12 based on the created data. As a formation method of the printing layer or the like 25, for example, a method such as a screen printing or a curved surface printing can be adopted. Note that the printing layer or the like 25 may be formed between the surface of the metal push button 10 and the transparent resin sheet 11.

When a urethane resin is used as the transparent resin sheet 11, higher extendibility can be expected compared with PET. Accordingly, even in the case where a pressure at a time of filling the transparent rubber-like elastic material 12 is relatively small, or even in the case where a thickness of the metal push button 10 is large, the transparent resin sheet 11 and the transparent rubber-like elastic material 12 can be easily filled in the gap between the adjacent metal push buttons 10.

Further, the member for a push button switch 30 shown in FIG. 7(*b*) is different from the member for a push button switch 30 shown in FIG. 7(*a*) in having a structure in which the transparent organic polymer material 15 projects from the transparent resin coated layer 13 formed on the surface of the metal push button 10 toward the surface side. When the gap between the metal push buttons 10 is made to have a convex shape in this manner, a position of each metal push button 10 can be easily grasped by touch. In particular, if a part or all of the periphery of a push button having a number "5" is made to have a convex shape, there can be provided a role similar to a role of a projection of the surface of the push button having the number "5" in an existing cellular phone. In addition, it is more advantageous when the transparent organic polymer material 15 is made to project than when a part of the surface of the metal push button 10 is made to project, in view of protection of user's fingers. The structure shown in FIG. 7(*b*) can be easily formed, for example, by providing a concave portion on the concave interior surface of a molding die. Further, it is possible that, among the metal push buttons 10, a hole having the shape of the number "5" is provided in the push button having the number "5" so that the transparent organic polymer material 15 is projected from the rear side to the hole, whereby there can be provided the role similar to the role of the projection of the surface of the push button having the number "5" in the existing cellular phone. Further, the transparent organic polymer material 15 may be projected not only to the surface of the push button having the number "5" but also to a surface of a push button having other number such that each push button is recognized by touch.

Fourth Embodiment

Next, a description is made on the member for a push button switch according to the present invention and a method of manufacturing the same according to the fourth embodiment.

A member for a push button switch 40 according to the fourth embodiment has component parts common to the member for a push button switch 1 according to the first embodiment described above. For this reason, the same symbols are used in the component parts common to the member for a push button switch 40 according to the fourth embodiment and the member for a push button switch 1 according to the first embodiment, and an overlapping description is omitted. Further, in the manufacturing method according to the fourth embodiment, any of each manufacturing method according to the first embodiment and the second embodiment, which is described above, may be adopted.

Figure 8:
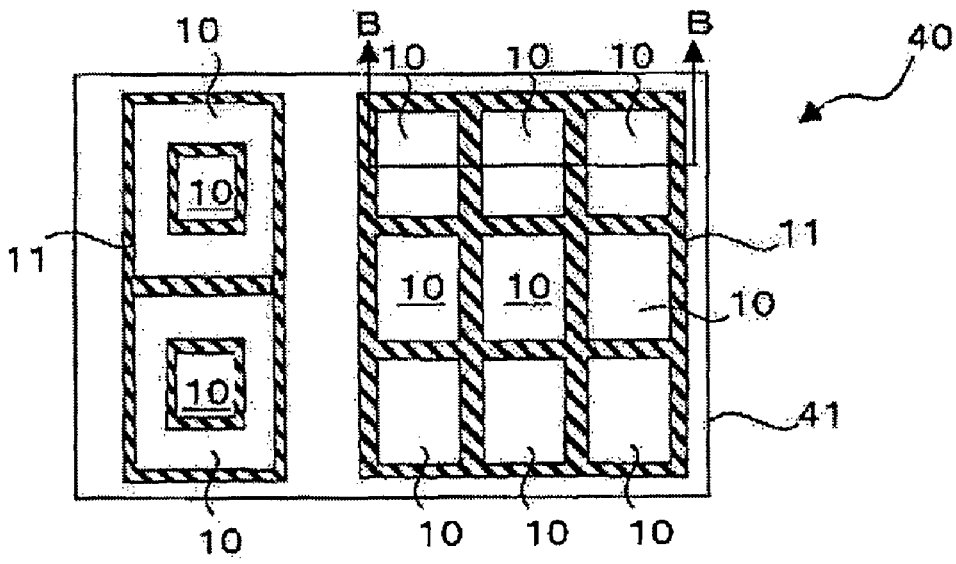
FIGS. 8(*a*) and 8(*b*) are views in which FIG. 8(*a*) is a plan view of a member for a push button switch according to a fourth embodiment of the present invention, and FIG. 8(*b*) is a cross-sectional view taken along the line B-B of the plan view of FIG. 8(*a*).
Figure 8:
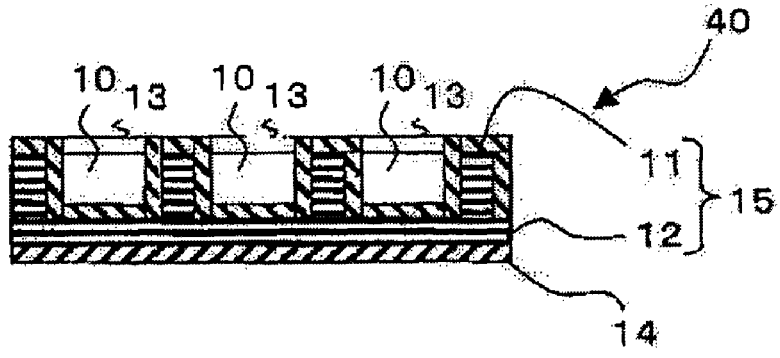

FIGS. 8(*a*) and 8(*b*) include a plan view FIG. 8(*a*) of the member for a push button switch 40 according to the fourth embodiment of the present invention, and a cross-sectional view FIG. 8(*b*) taken along the line B-B of the plan view of FIG. 8(*a*).

Each metal push buttons 10 and an external frame 41 are integrated in the member for a push button switch 40. The member for a push button switch 40 has a structure in which the transparent organic polymer material 15 (including the transparent resin sheet 11 and the transparent rubber-like elastic material 12) is filled from a rear side thereof in the gaps between the adjacent metal push buttons 10 floating like islands, and in a gap between the metal push buttons 10 and the external frame 41. The member for a push button switch 40 has the structure similar to that of the member for a push button switch 1 according to the first embodiment. With such a structure, unity between the metal push buttons 10 and the external frame 41 can be obtained with more ease.

Fifth Embodiment

Next, a description is made on the member for a push button switch according to the present invention and a method of manufacturing the same according to the fifth embodiment.

A member for a push button switch 50 according to the fifth embodiment has component parts common to the member for a push button switch 1 according to the first embodiment described above. For this reason, the same symbols are used in the component parts common to the member for a push button switch 50 according to the fifth embodiment and the member for a push button switch 1 according to the first embodiment, and an overlapping description is omitted. Further, in the manufacturing method according to the fifth embodiment, any of each manufacturing method according to the first embodiment and the second embodiment, which is described above, may be adopted.

Figure 9:
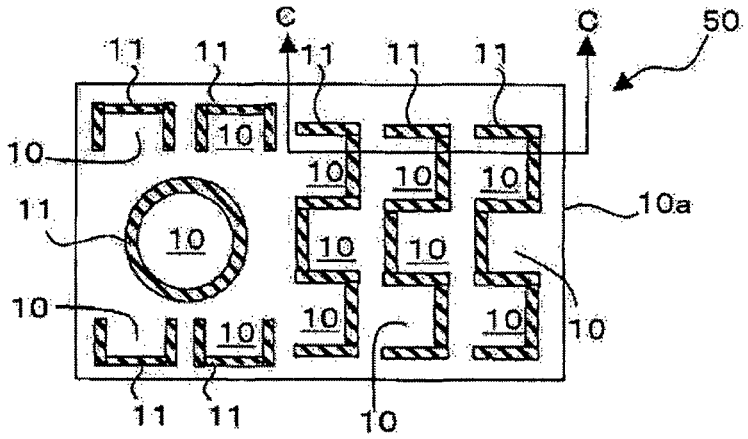
FIGS. 9(*a*) and 9(*b*) are views in which FIG. 9(*a*) is a plan view of a member for a push button switch according to a fifth embodiment of the present invention, and FIG. 9(*b*) is a cross-sectional view taken along the line C-C of the plan view of FIG. 9(*a*).
Figure 9:
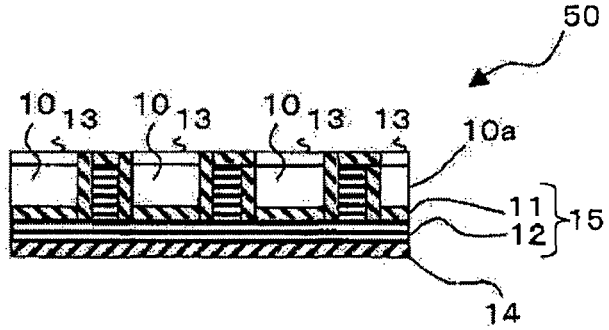

FIGS. 9(*a*) and 9(*b*) include a plan view FIG. 9(*a*) of the member for a push button switch 50 according to the fifth embodiment of the present invention, and a cross-sectional view FIG. 9(*b*) taken along the line C-C of the plan view of FIG. 9(*a*).

In the member for a push button switch 50, a part of each metal push button 10 is not separated but co-joined with each other through a part of a cut. From a rear side of the cut, the transparent organic polymer material 15 is filled. In this manner, in the case of forming a region where each metal push button 10 is not completely separated, the transparent organic polymer material 15 is filled in a cut dividing the adjacent metal push buttons 10, whereby the same operational advantages as those of the member for a push button switch 1, 30, and 40 according to each embodiment described above can be obtained.

Sixth Embodiment

Next, a description is made on the member for a push button switch according to the present invention and a method of manufacturing the same according to the sixth embodiment.

A member for a push button switch 60 according to the sixth embodiment has component parts common to the member for a push button switch 1 according to the first embodiment described above. For this reason, the same symbols are used in the component parts common to the member for a push button switch 60 according to the sixth embodiment and the member for a push button switch 1 according to the first embodiment, and an overlapping description is omitted.

Figure 10:
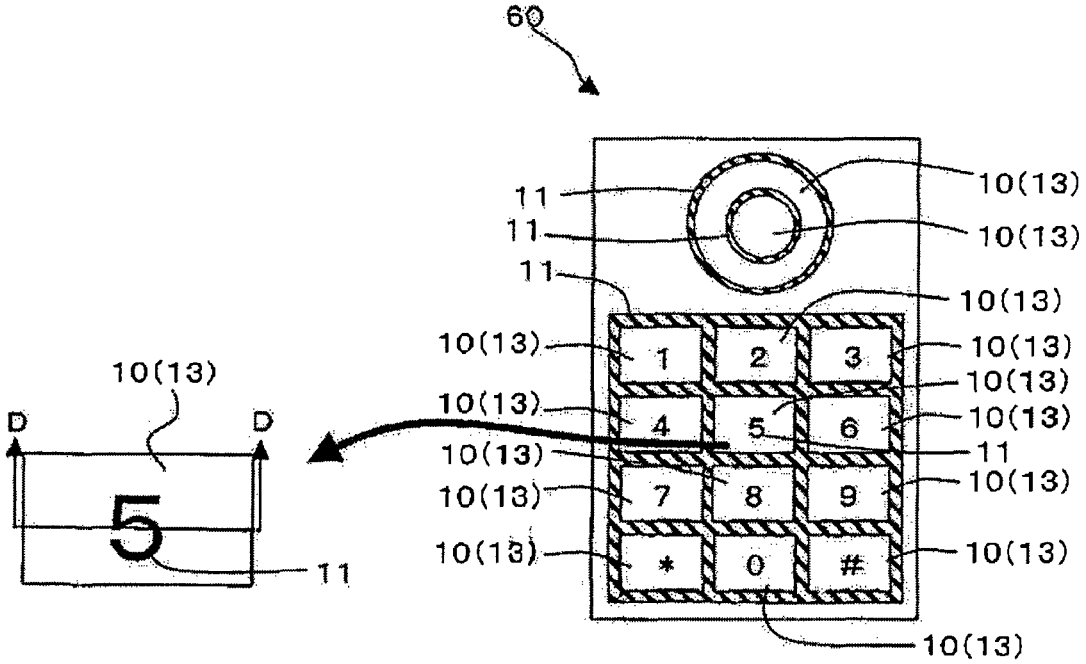
FIG. 10 includes a view showing a member for a push button switch according to a sixth embodiment of the present invention and an enlarged view showing one of a plurality of metal push buttons forming the member for a push button switch.
Figure 11:
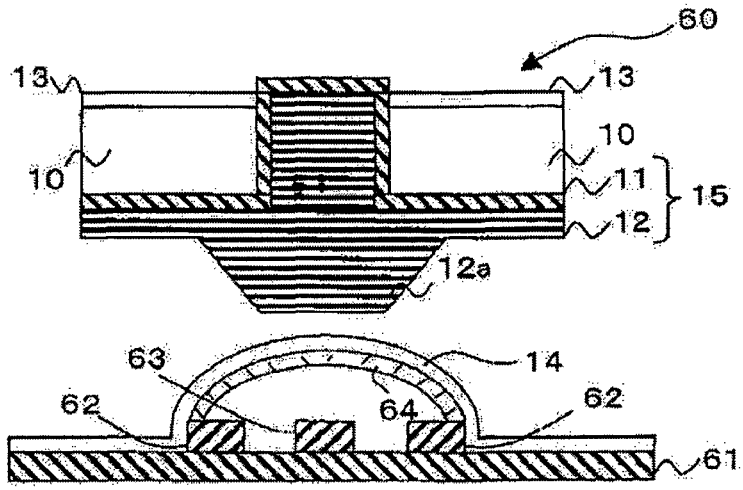
FIG. 11 includes a cross-sectional view of the one of the plurality of metal push buttons, which is taken along the line D-D of FIG. 10 and a view showing a substrate disposed below the metal push button.

FIG. 10 includes a view showing the member for a push button switch 60 according to the sixth embodiment and an enlarged view showing one of a plurality of metal push buttons 10 forming the member for a push button switch 60. In FIG. 10, the surface of the metal push button 10 is coated with the transparent resin coated layer 13, so a reference numeral denoting the metal push button 10 is presented by "10(13)". FIG. 11 includes a cross-sectional view of one of the metal push buttons 10, which is taken along the line D-D of FIG. 10, and a view showing a substrate 61 disposed below the metal push button 10.

As shown in FIG. 11, the transparent organic polymer material 15 is in a state of projecting from the transparent resin coated layer 13 toward the surface side. A hole having a shape of a number, a character, or a symbol which is to be indicated thereon is made in the metal push button 10, and the transparent organic polymer 15 is made to project from the rear side to the hole, whereby each metal push button 10 can be easily recognized by touch. Moreover, the designability as a three-dimensional character can be improved.

The transparent rubber-like elastic material 12 has a presser 12*a* for pushing a fixed contact (switch). Switches 62, 62, and 63 are arranged in the substrate 61. A metal disc spring 64 fixes its opening edges to the switches 62, 62. In space inside the metal disc spring 64, the switch 63 electrically connected to the substrate 61 is disposed so as not to be contact with the metal disc spring 64. On a surface of the metal disc spring 64 and a surface of the substrate 61, the light emitting member 14 such as an EL sheet is disposed.

When the metal push button 10 is pushed, the presser 12*a* formed below the transparent rubber-like elastic material 12 pushes the metal disc spring 64 from above the light emitting member 14. As a result, the metal disc spring 64 is elastically dented and pushes the switch 63. When the pushing of the metal push button 10 is released, the presser 12*a* is released from the metal disc spring 64, and the metal disc spring 64 also returns to the original hemispherical shape. Accordingly, the pushing of the switch 63 is also released.

Next, an example of the method of manufacturing the member for a push button switch 60 according to the sixth embodiment is described.

Figure 12:
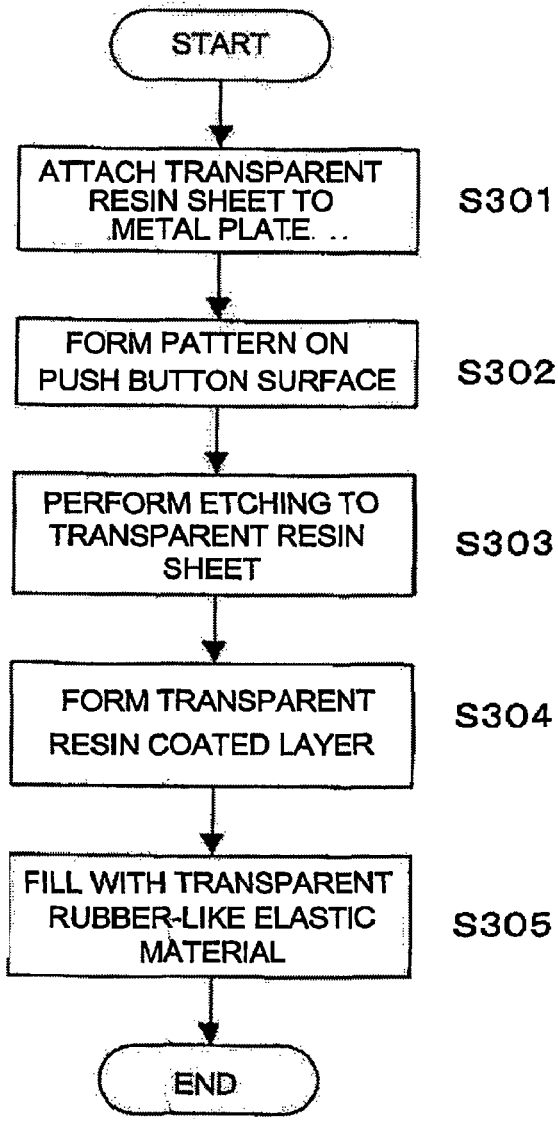
FIG. 12 is a flowchart showing an example of a method of manufacturing the member for a push button switch according to the sixth embodiment of the present invention.
Figure 13:
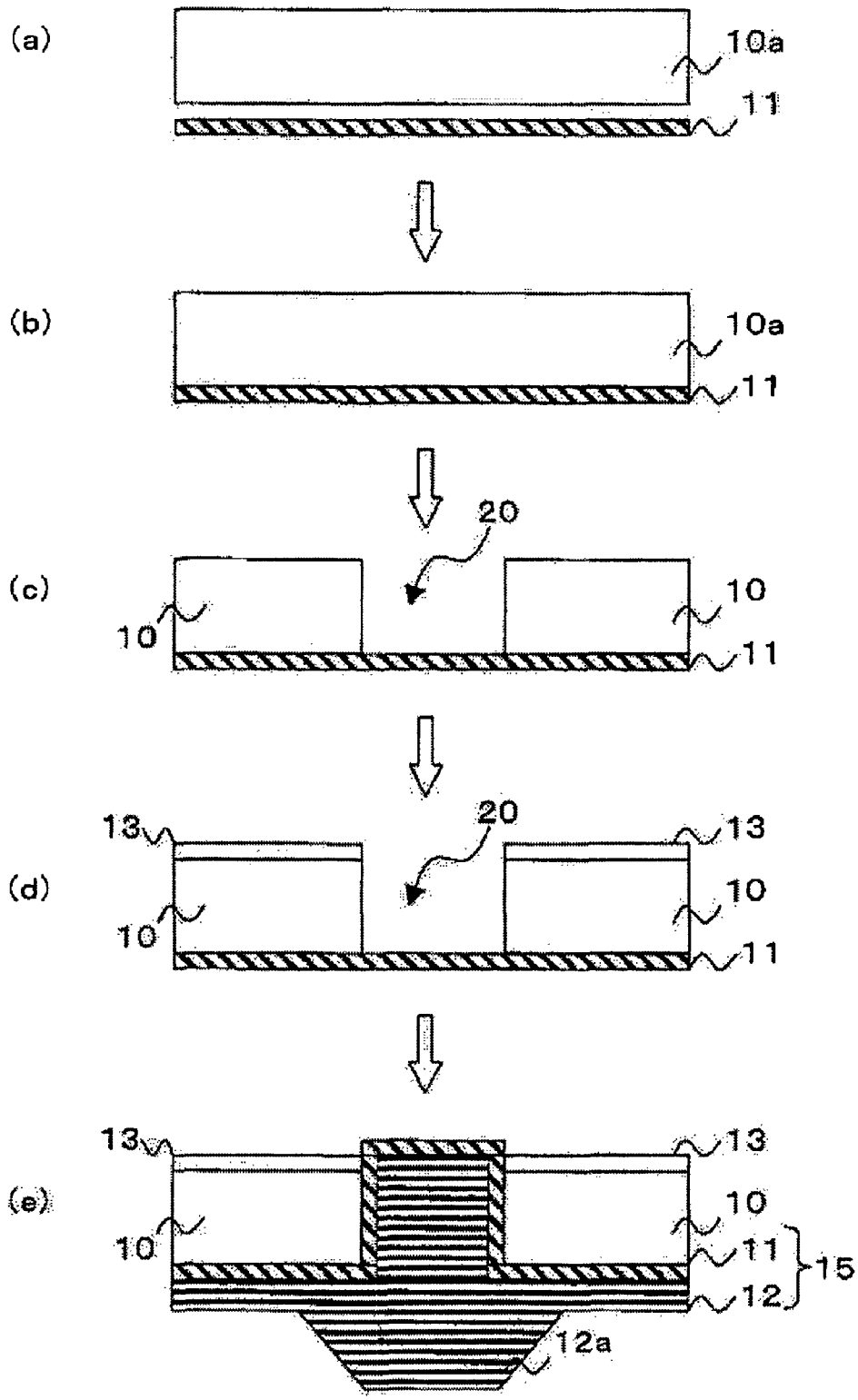
FIGS. 13(*a*) through 13(*e*) are views showing a state in each step of manufacturing the member for a push button switch according to the sixth embodiment of the present invention.

FIG. 12 is a flowchart showing an example of the method of manufacturing the member for a push button switch 60 according to the sixth embodiment. FIGS. 13(*a*) through 13(*e*) are views showing a state in each step of manufacturing the member for a push button switch 60 according to the sixth embodiment.

Step S301 to Step S304 of the flowchart shown in FIG. 12 are the same steps as Step S101 to Step S104 of the flowchart shown in FIG. 3, respectively. Similarly, a state shown in each of FIGS. 13(*a*) to 13(*d*) is the same state of each of FIGS. 4(*a*) to 4(*d*) shown in FIG. 4. However, in the case of the member for a push button switch 60 according to the sixth embodiment, the hole 20 is formed in the metal push button 10 itself, and the transparent organic polymer material 15 is filled also in the hole 20. Accordingly, in Step S303 shown in FIG. 12, etching is performed such that the hole 20 is formed not only in the gap between the adjacent metal push buttons 10, but also in the metal push button 10 itself. Further, FIG. 13 show a state where a cross-sectional part of the metal push button 10 shown in FIG. 11 changes as the manufacturing process advances. As for the manufacturing process, many parts thereof overlap the manufacturing process described in the first embodiment, so a description thereof is omitted. In the sixth embodiment, parts significantly different from the first embodiment are that the transparent rubber-like elastic material 12 has the shape having the presser 12*a*, and that the step (Step S106) of attaching the light emitting member 14 to a bottom surface of the transparent rubber-like elastic material 12 does not exist. This is because the light emitting member 14 may be disposed on the substrate 61 side.

Note that, as in the case of the embodiment described above, the printing layer or the like 25 may be formed in the transparent resin sheet 11 in advance. The timing of the formation may be before or after attaching the transparent resin sheet 11 to the metal plate 10*a*.

Seventh Embodiment

Next, a description is made on the member for a push button switch according to the present invention and a method of manufacturing the same according to the seventh embodiment.

A member for a push button switch 70 according to the seventh embodiment has component parts common to the member for a push button switch 1 according to the first embodiment described above. For this reason, the same symbols are used in the component parts common to the member for a push button switch 70 according to the seventh embodiment and the member for a push button switch 1 according to the first embodiment, and an overlapping description is omitted.

Figure 14:
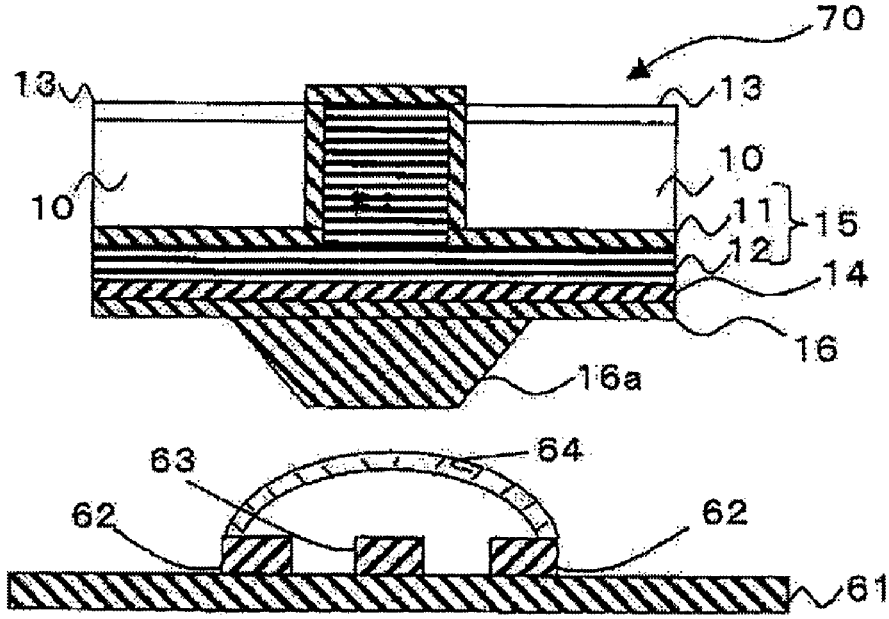
FIG. 14 includes a cross-sectional view of one of metal push buttons forming a member for a push button switch according to a seventh embodiment of the present invention, which is taken along the line D-D of FIG. 10, and a view showing a substrate disposed below the metal push button.

FIG. 14 includes a cross-sectional view of one of the metal push buttons 10 forming the member for a push button switch 70 according to the seventh embodiment, which is taken along the same line as the line D-D of FIG. 10, and a view showing the substrate 61 disposed below the metal push button 10.

As shown in FIG. 14, the transparent organic polymer material 15 is in a state of projecting from the transparent resin coated layer 13 toward the surface side. A hole having a shape of a number, a character, or a symbol which is to be indicated thereon is made in the metal push button 10, and the transparent organic polymer 15 is made to project to the hole from the rear side, whereby each metal push button 10 can be easily recognized by touch. Moreover, the designability as a three-dimensional character can be improved.

The light emitting member 14 such as an EL sheet is disposed below the transparent rubber-like elastic material 12 of the member for a push button switch 70, and a pusher sheet (sheet) 16 having a presser 16*a* is disposed therebelow. The pusher sheet 16 may be transparent or opaque. In this manner, the light emitting member 14 may be disposed on the member for a push button switch 70 side, not on the substrate 61 side. The fixed contacts (switches) 62, 62, and 63 are arranged in the substrate 61. The metal disc spring 64 fixes its opening edges to the switches 62, 62. In space inside the metal disc spring 64, the switch 63 electrically connected to the substrate 61 is disposed so as not to be contact with the metal disc spring 64.

When the metal push button 10 is pushed, the presser 16*a* of the pusher sheet 16 pushes the metal disc spring 64. As a result, the metal disc spring 64 is elastically dented and pushes the switch 63. When the pushing of the metal push button 10 is released, the presser 16*a* is released from the metal disc spring 64, and the metal disc spring 64 also returns to the original hemispherical shape. Accordingly, the pushing of the switch 63 is also released.

Next, an example of the method of manufacturing the member for a push button switch 70 according to the seventh embodiment is described.

Figure 15:
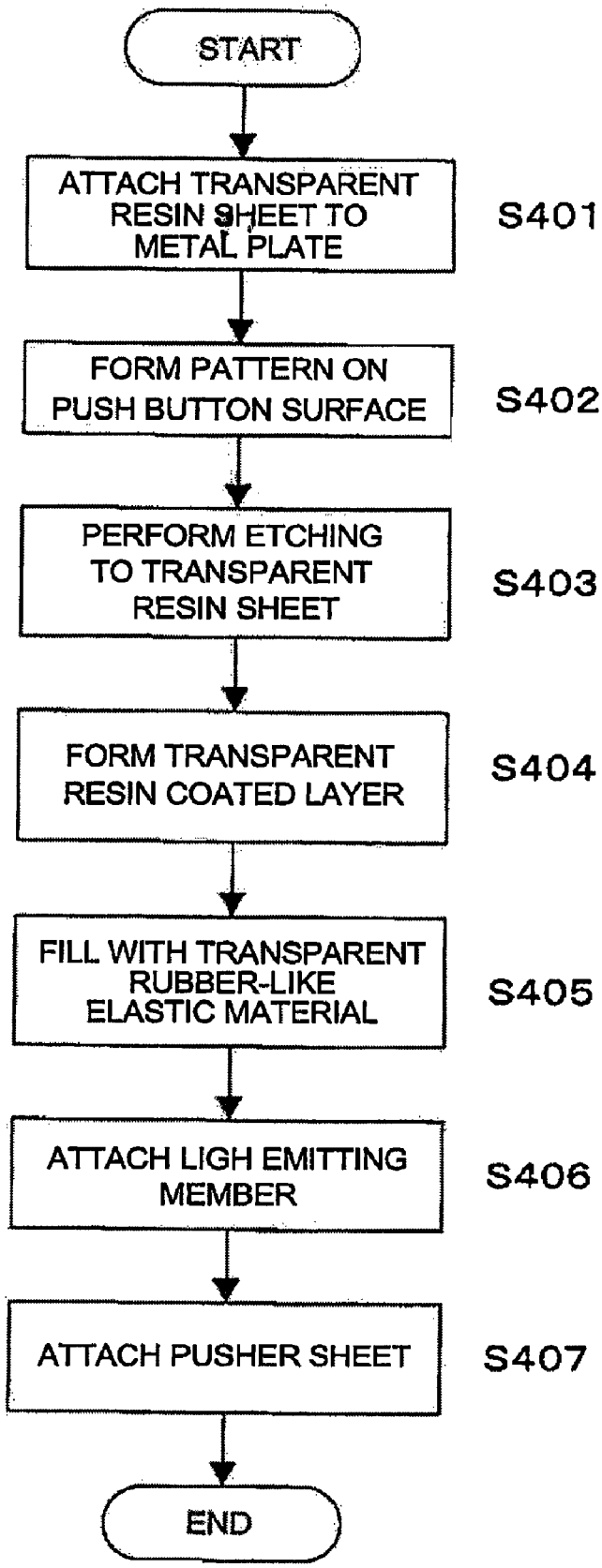
FIG. 15 is a flowchart showing an example of a method of manufacturing the member for a push button switch according to the seventh embodiment of the present invention.
Figure 16:
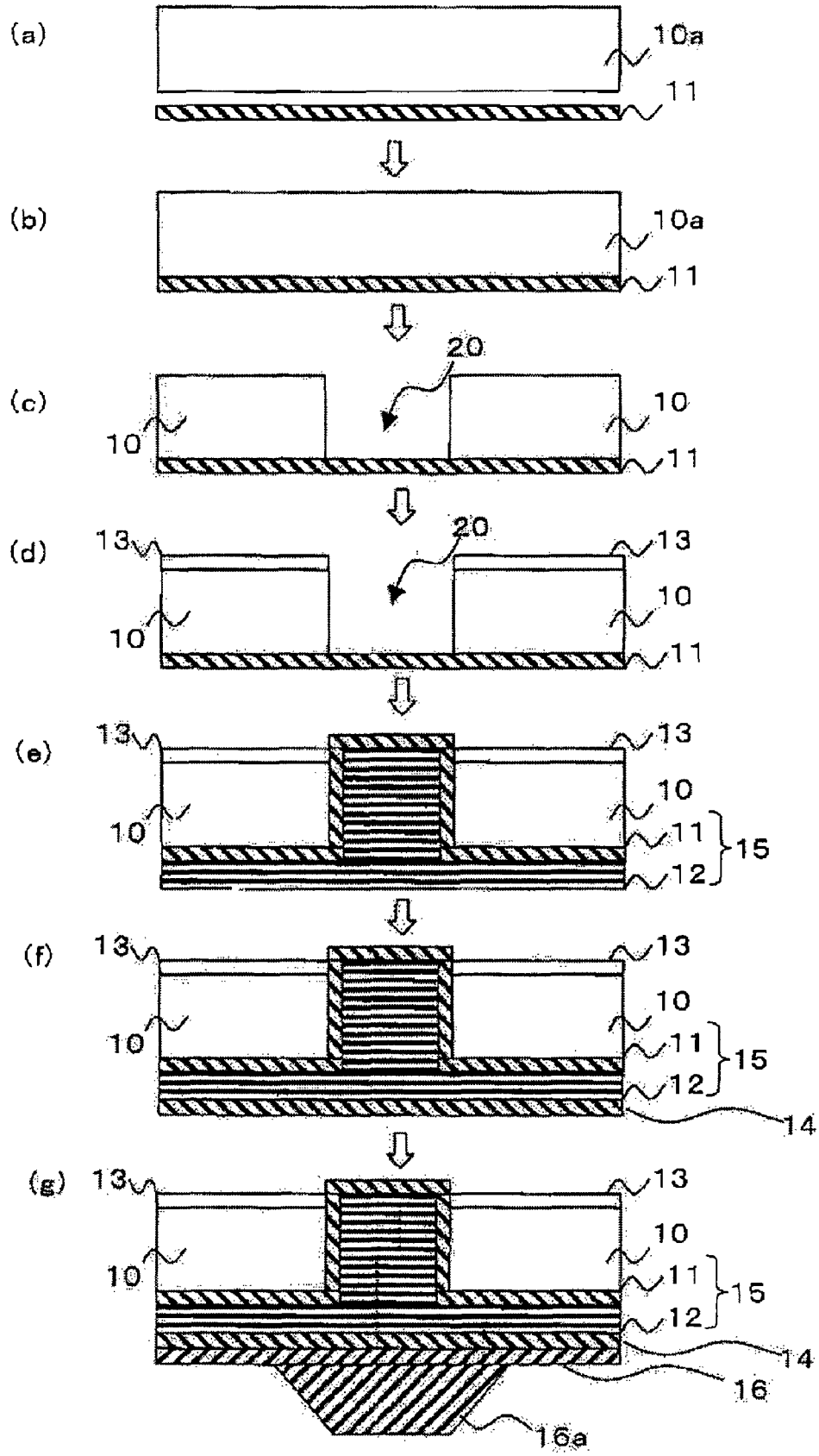
FIGS. 16(*a*) through 16(*g*) are views showing a state in each step of manufacturing the member for a push button switch according to the seventh embodiment of the present invention.

FIG. 15 is a flowchart showing an example of the method of manufacturing the member for a push button switch 70 according to the seventh embodiment. FIGS. 16(*a*) through 16(*g*) are views showing a state in each step of manufacturing the member for a push button switch 70 according to the seventh embodiment.

Step S401 to Step S406 of the flowchart shown in FIG. 15 are the same steps of Step S101 to Step S106 of the flowchart shown in FIG. 3, respectively. Similarly, the state shown in each of FIGS. 16(*a*) to 16(*f*) is the same state of each of FIGS. 4(*a*) to 4(*f*). However, in the case of the member for a push button switch 70 according to the seventh embodiment, the hole 20 is formed in the metal push button 10 itself, and the transparent organic polymer material 15 is filled also in the hole 20. Accordingly, in Step S403 shown in FIG. 15, etching is performed such that the hole 20 is formed not only in the gap between the adjacent metal push buttons 10 but also in the metal push button 10 itself. Further, FIG. 16 show a state where a cross-sectional part of the metal push button 10 shown in FIG. 14 changes as the manufacturing process advances. The manufacturing process overlaps the manufacturing process described in the first embodiment, so a description thereof is omitted. In the seventh embodiment, a part different from the first embodiment is that the step (Step S407) of attaching the pusher sheet 16 having the presser 16*a* to below the light emitting member 14 exists. The pusher sheet 16 is a necessary member because of the structure of an electronic device such as a cellular phone. However, it is assumed that the member for a push button switch according to the present invention is broadly interpreted to include both of the state where the pusher sheet is attached and the state where the pusher sheet is not attached. Note that, after Step S405, the step of attaching the light emitting member 14 to the pusher sheet 16 may be performed, and after that, the step of attaching the light emitting member 14 side of the member obtained in the attaching step to the transparent rubber-like elastic material 12 may be performed. Further, after Step S405, there may be performed the step of integrally forming the light emitting member 14 and the rubber-like elastic material having the presser 16*a*, and the step of attaching the light emitting member 14 side obtained in the integrally forming step to the transparent rubber-like elastic material 12.

Note that, as in the case of the embodiment described above, the printing layer or the like 25 may be formed in the transparent resin sheet 11 in advance. The timing of the formation may be before or after attaching the transparent resin sheet 11 to the metal plate 10*a*.

Eighth Embodiment

Next, a description is made on the member for a push button switch according to the present invention and a method of manufacturing the same according to the eighth embodiment.

A member for a push button switch 80 according to the eighth embodiment has component parts common to the member for a push button switch 1 according to the first embodiment described above. For this reason, the same symbols are used in the component parts common to the member for a push button switch 80 according to the eighth embodiment and the member for a push button switch 1 according to the first embodiment, and an overlapping description is omitted.

Figure 17:
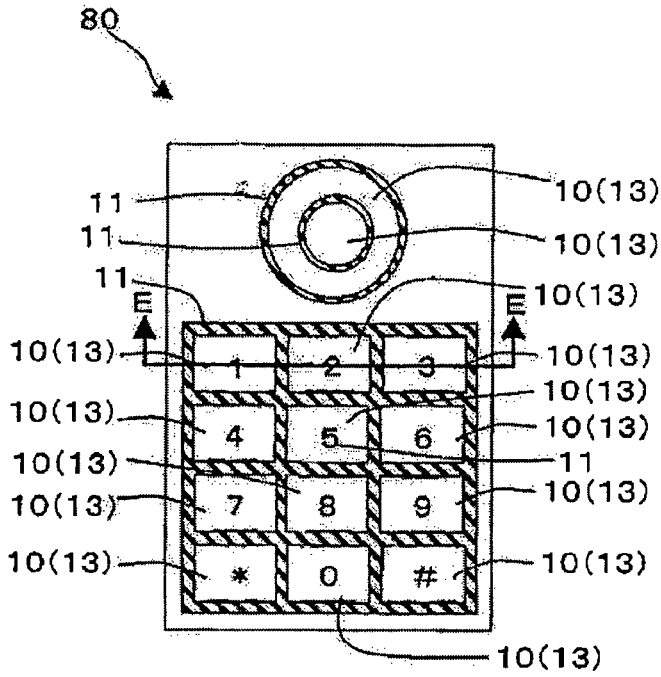
FIG. 17 is a plan view of a member for a push button switch according to an eighth embodiment of the present invention.
Figure 18:
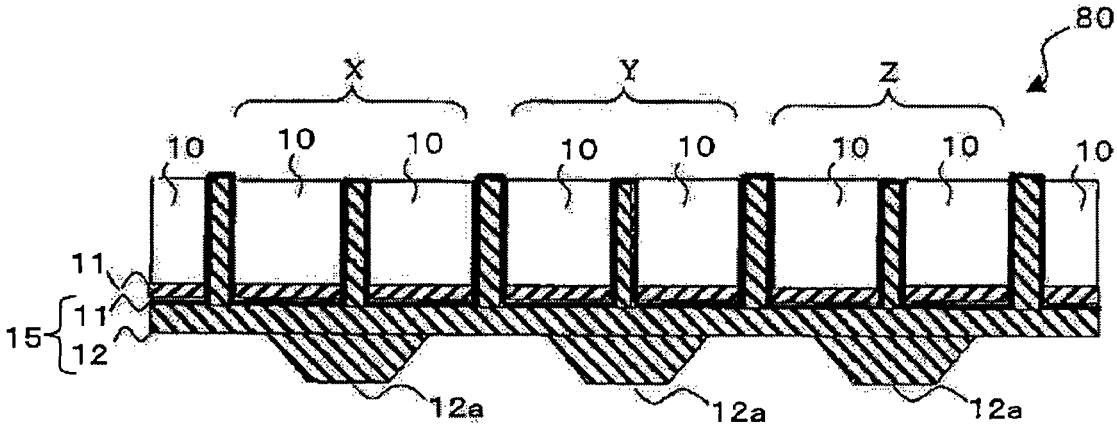
FIG. 18 is a cross-sectional view taken along the line E-E of FIG. 17.

FIG. 17 is a plain view of the member for a push button switch 80 according to the eighth embodiment. FIG. 18 is a cross-sectional view taken along the line E-E of FIG. 17. In FIG. 18, X is a metal push button 10 having "1" indicated thereon, which is shown in FIG. 17, Y is a metal push button 10 having "2" indicated thereon, which is shown in FIG. 17, and Z is a metal push button 10 having "3" indicated thereon, which is shown in FIG. 17.

As shown in FIG. 18, the transparent resin sheet 11 is disposed on the rear side of the metal push button 10. Another transparent resin sheet (In FIG. 18, represented by a black heavy line) 11 is disposed over a rear side of the transparent resin sheet 11, an interior surface of the hole inside the metal push button 10, and the top surface of the hole. The transparent rubber-like elastic material 12 is disposed on the rear side of the another transparent resin sheet 11. A transparent organic polymer material 15 composed of the another transparent resin sheet 11 and the transparent rubber-like elastic material 12 is attached so as to fill the gap between the adjacent metal push buttons 10 and the hole inside the metal push button 10 from the rear surface of the metal push button 10. At a position below the metal push button 10 in the transparent rubber-like elastic material 12, the presser 12*a* is formed. Note that a light emitting member (not shown) is disposed on the substrate side which is disposed below the member for a push button switch 80, not on the member for a push button switch 80 side.

Next, an example of the method of manufacturing the member for a push button switch 80 according to the eighth embodiment is described.

Figure 19:
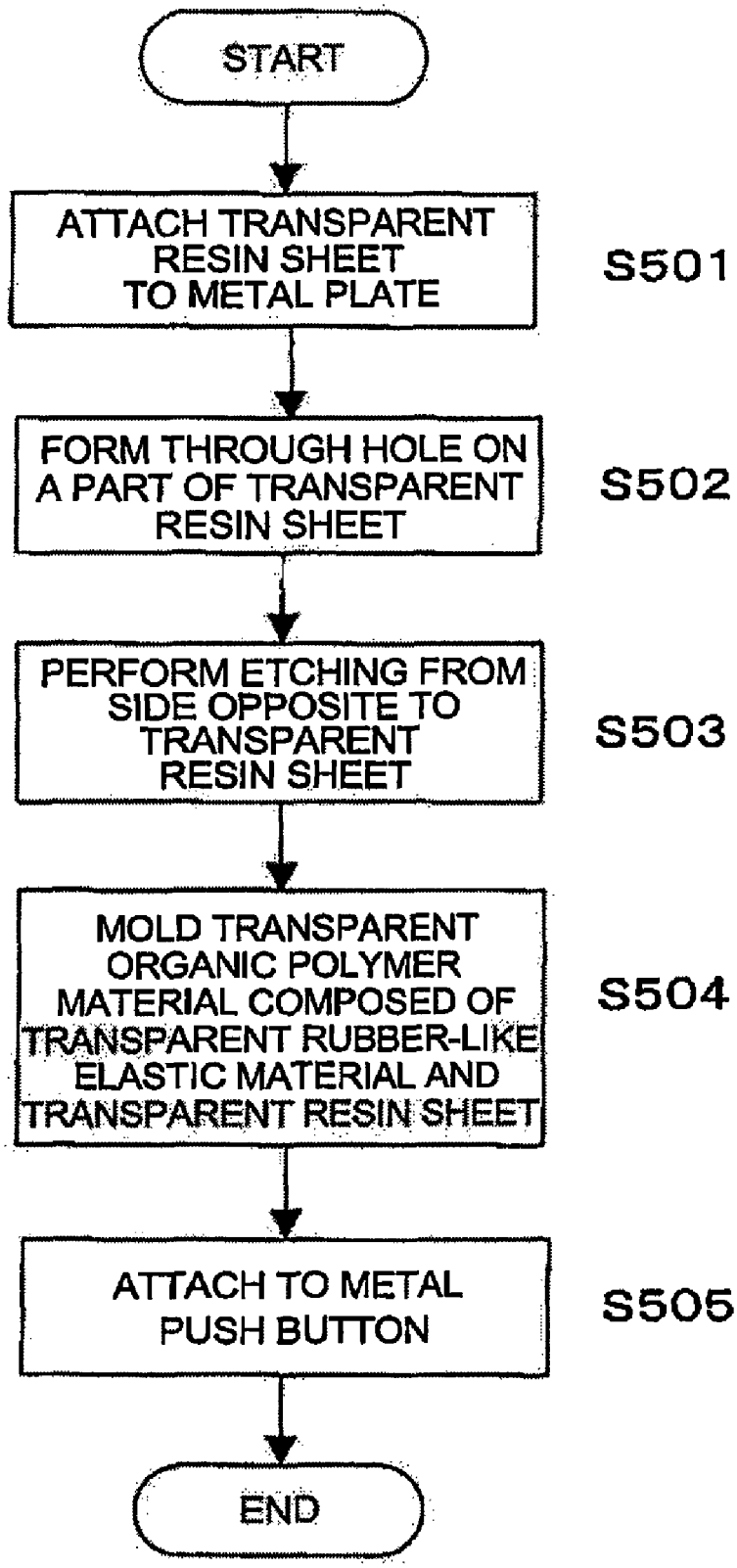
FIG. 19 is a flowchart showing an example of a method of manufacturing the member for a push button switch according to the eighth embodiment of the present invention.
Figure 20:
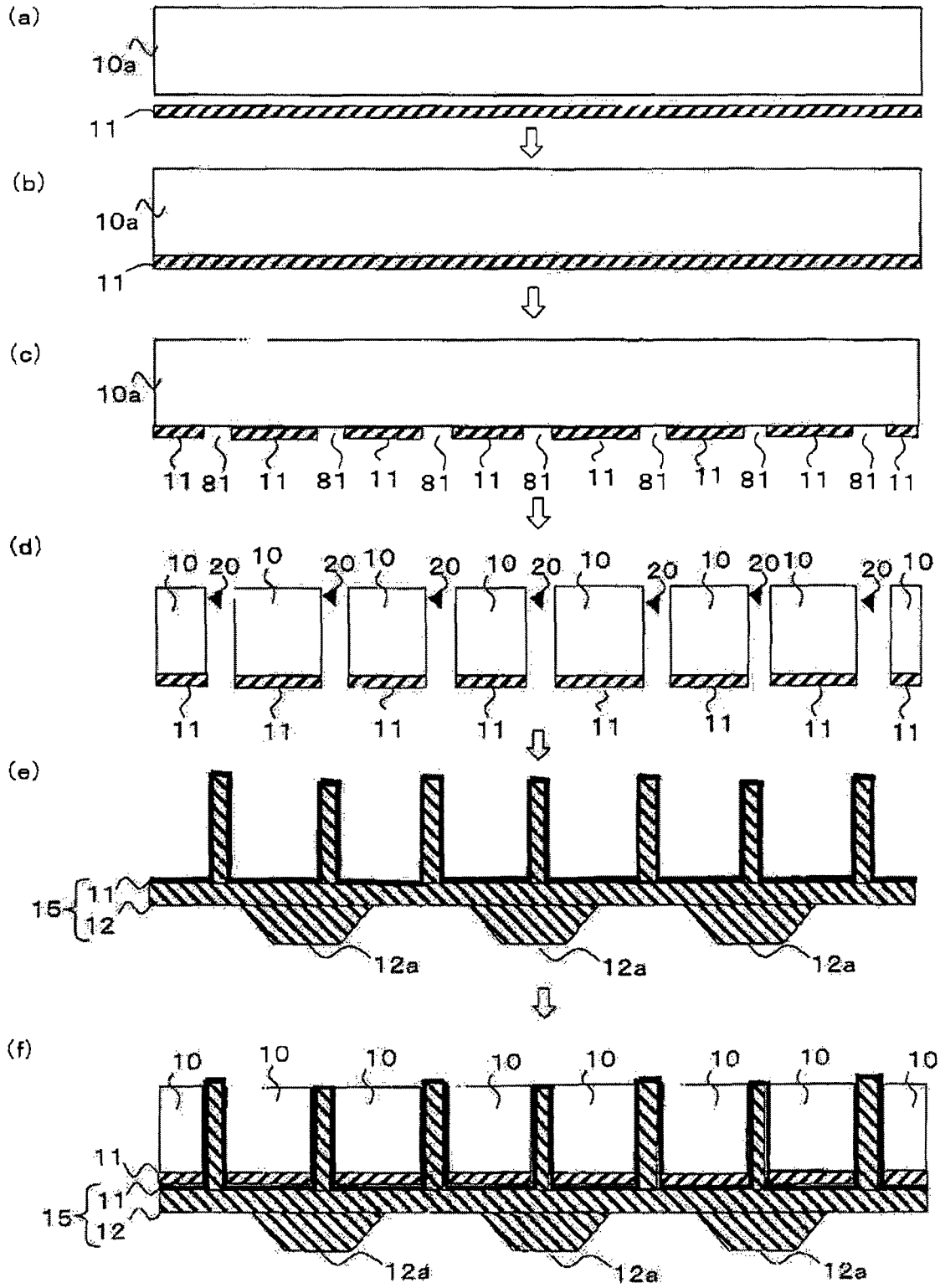
FIGS. 20(*a*) through 20(*f*) are views showing a state in each step of manufacturing the member for a push button switch according to the eighth embodiment of the present invention.

FIG. 19 is a flowchart showing an example of the method of manufacturing the member for a push button switch 80 according to the eighth embodiment. FIGS. 20(*a*) through 20(*f*) are views showing a state in each step of manufacturing the member for a push button switch 80 according to the eighth embodiment.

First, the transparent resin sheet 11 is attached to one surface side of the metal plate 10*a* which is in a state before processing the metal push button 10 (Step S501). Although a thermosetting adhesive which demonstrates an adhesive function by heat is preferably used in this attachment, a double-sided tape or an adhesive capable of becoming cured at room temperature may also be used. Through this Step S501, the member for a push button switch 80 becomes the state shown in FIG. 20(*b*) from the state shown in FIG. 20(*a*). Next, a through hole 81 is formed on a part of the transparent resin sheet 11 (Step S502). This through hole 81 is formed according to a shape of a character or the like which is indicated on the metal push button 10 and each of its surface. When the through hole 81 is provided on the entire periphery of the metal push button 10, the metal push button 10 drops. Thus, the through hole 81 is provided so as to leave a part of the periphery. Through Step S502, the member for a push button switch 80 becomes the state shown in FIG. 20(*c*) from the state shown in FIG. 20(*b*).

Next, the metal plate 10*a* is etched from the side opposite to the transparent resin sheet 11 to the transparent resin sheet 11 (Step S503). As a result, the hole 20 is formed. Note that the transparent resin sheet 11 does not exist in the part of the through hole 81. Through Step S503, the member for a push button switch 80 becomes the state shown in FIG. 20(*d*) from the state shown in FIG. 20(*c*).

Next, another transparent resin sheet 11 is made to overlap the transparent rubber-like elastic material 12, whereby a molding having a convex portion for filling the hole 20 and the presser 12*a* below each metal push button 10 is manufactured (Step S504). Although the preferable molding method is an injection molding, a molding method other than this may be adopted. Through Step S504, the transparent organic polymer material 15 as shown in FIG. 20(*e*) is obtained.

Next, the component member including the metal push button 10 manufactured in Steps S501 to S503 and the transparent resin sheet 11 is attached to the transparent organic polymer material 15 manufactured in Step S504 (Step S505). In this manner, the member for a push button switch 80 shown in FIG. 20(*f*) is obtained.

Note that, in Step S504, only the transparent rubber-like elastic material 12 can be attached to the component member including the metal push button 10 and the transparent resin sheet 11 without using the another transparent resin sheet 11. Further, a decorative printing layer can be formed in the transparent organic polymer material 15 interposed inside the metal push button 10. In this case, the decorative printing layer may be formed in at least any of the transparent rubber-like elastic material 12 and the another transparent resin sheet 11.

Ninth Embodiment

Next, a description is made on the member for a push button switch according to the present invention and a method of manufacturing the same according to the ninth embodiment.

A member for a push button switch 90 according to the ninth embodiment has component parts common to the member for a push button switch 1 according to the first embodiment described above. For this reason, the same symbols are used in the component parts common to the member for a push button switch 90 according to the ninth embodiment and the member for a push button switch 1 according to the first embodiment, and an overlapping description is omitted.

Figure 21:
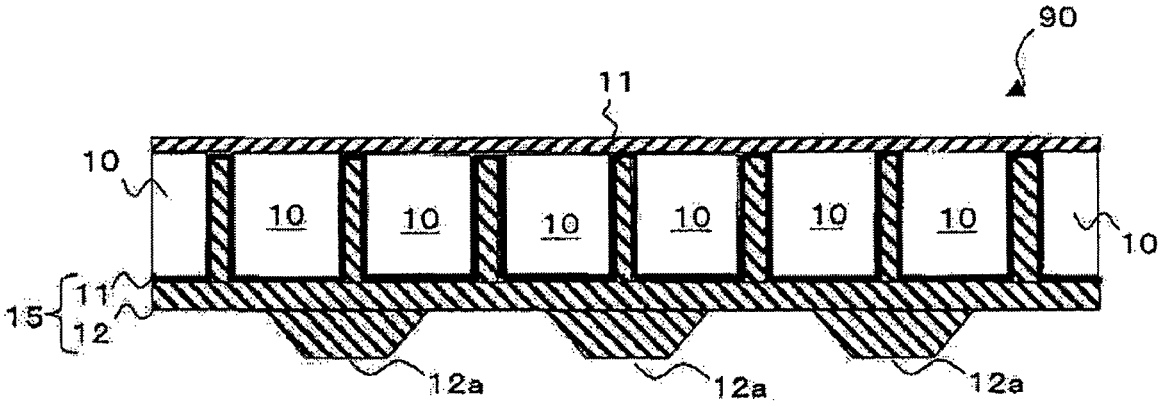
FIG. 21 is a cross-sectional view of a member for a push button switch according to a ninth embodiment of the present invention, which is taken along the line E-E of FIG. 17.

FIG. 21 is a cross-sectional view of the member for a push button switch 90 according to the ninth embodiment, which is taken along the same line as the line E-E shown in FIG. 17.

The member for a push button switch 90 according to the ninth embodiment has the transparent resin sheet 11 on the surface side of the metal push button 10. Also, from a surface side opposite to the transparent resin sheet 11, the transparent organic polymer material 15 composed of the another transparent resin sheet 11 and the transparent rubber-like elastic material 12 is disposed so as to fill the gap between the adjacent metal push buttons 10 and a hole inside each metal push button 10. At a position below the metal push button 10 in the transparent rubber-like elastic material 12, the presser 12*a* is formed.

The member for a push button switch 90 of a structure shown in FIG. 21 can be manufactured by, after the state shown in FIG. 20*b*, etching from the surface side opposite to the attached transparent resin sheet 11 and attaching the transparent organic polymer material 15 shown in FIG. 20*e* to the side of the hole 20 which is formed through the etching.

The member for a push button switch 90 shown in FIG. 21 can be manufactured also by a manufacturing method different from the aforementioned manufacturing method, which is described below. First, the transparent resin sheet 11 is attached to one surface of the metal plate 10*a*, and etching is performed from the side opposite to the transparent resin sheet 11. After that, another transparent resin sheet 11 is attached to an opening side of the hole 20 formed through the etching. Next, from any of the transparent resin sheets 11 on the both sides, the transparent rubber-like elastic material 12 is press-fitted toward the hole 20.

Further, a printing layer can be formed on a part or entire of the rear side of the transparent resin sheet 11 attached to the outer surface of the metal push button 10.

Each preferable embodiment of the member for a push button switch according to the present invention and the method of manufacturing the same has been described above, but the present invention is not limited thereto and can be performed through various modifications.

For instance, attachment of the metal plate 10*a* to the transparent resin sheet 11 may be performed by roughing a surface of the metal plate 10*a* and depositing the transparent resin sheet 11 to the roughed surface, not performed through an adhesive material such as an adhesive and a double-sided tape.

Also, in the case of filling the hole 20 with both the transparent rubber-like elastic material 12 and the transparent resin sheet 11, when the transparent resin sheet 11 is subjected to a primer processing and the transparent rubber-like elastic material 12 is supplied to the surface subjected to the primer processing, adhesiveness between the transparent resin sheet 11 and the transparent rubber-like elastic material 12 is improved, which is preferable.

Also, in the method of manufacturing the member for a push button switch according to the first embodiment of the present invention, Step S101 and Step S102 of the flowchart shown in FIG. 3 may be performed in reverse. Also, Step S104 may be performed after Step S105 or Step S106. Further, at least any one of Step S102, Step S104, and Step S106 may not be performed.

Also, in the method of manufacturing the member for a push button switch according to the second embodiment of the present invention, Step S203 of the flowchart shown in FIG. 5 may be performed before Step S201, Step S202, or Step S205. Also, Step S205 may be performed after Step S206 or Step S207. Further, at least any one of Step S203, Step 205, and Step 207 may not be performed.

Also, in the method of manufacturing the member for a push button switch according to the sixth embodiment of the present invention, Step S301 and Step S302 of the flowchart shown in FIG. 12 may be performed in reverse. Also, Step S304 may be performed after Step S305. Further, at least any one of Step S302 and Step 304 may not be performed.

Also, in the method of manufacturing the member for a push button switch according to the seventh embodiment of the present invention, Step S401 and Step S402 of the flowchart shown in FIG. 15 may be performed in reverse. Also, Step S404 may be performed after Step S405, Step S406, or Step 407. Further, at least any one of Step S402, Step S404, and Step 406 may not be performed.

Also, in the method of manufacturing the member for a push button switch according to the eighth embodiment of the present invention, Step S501 and Step S502 of the flowchart shown in FIG. 19 may be performed in reverse. Also, Step S504 may be performed before any of Step S501 to Step S503.

INDUSTRIAL APPLICABILITY

The present invention can be used in the industry where a member for a push button switch of an electronic device is manufactured or used.

The invention claimed is:

1. A member for a push button switch having a configuration in which a gap between adjacent metal push buttons is filled with a transparent organic polymer material, wherein the organic polymer material comprises:

a transparent resin sheet extending from an interior surface of the gap to a ceiling surface side of the push button, the transparent resin having at least an interior wall contact portion, exposing portion, and interspace, the interior wall contact portion being in contact with the interior wall of the gap, the exposing portion extending to the ceiling side of the gap, the exposing portion being exposed at the ceiling side, and the interspace being surrounded by the at least interior wall contact portion and the exposing portion in the gap; and a transparent rubber-like elastic material disposed inside the interspace, the transparent rubber-like elastic material being surrounded by the transparent resin sheet.

2. A member for a push button switch according to claim 1, further comprising a printing layer or a coloring layer at least in a portion extending toward the ceiling surface side of the metal push button in the transparent resin sheet.

3. A member for a push button switch according to claim 2, wherein a surface of the metal push button has irregularities or a hole so that a number, a symbol, a pattern, or a graphic is formed.

4. A member for a push button switch according to claim 2, wherein a light emitting member is disposed between a surface opposite to the metal push button in the transparent rubber-like elastic material and a circuit board disposed therebelow.

5. A member for a push button switch according to claim 2, further comprising a configuration in which a hole penetrating the metal push button in a direction into and out of the metal push button is formed so that the transparent organic polymer material is made to extend from the hole toward the ceiling surface side of the metal push button.

6. A member for a push button switch according to claim 2, further comprising a sheet provided with a presser for pushing a switch below the transparent rubber-like elastic material.

7. A member for a push button switch according to claim 1, wherein the transparent organic polymer material projects from the surface of the metal push button.

8. A method of manufacturing a member for a push button switch having a configuration in which a gap between adjacent metal push buttons is filled with a transparent organic polymer material, the method comprising the steps of:

attaching a transparent resin sheet to one surface of a metal plate;

forming a hole by performing etching from a surface opposite to the surface having the transparent resin sheet attached thereto in the metal plate to the transparent resin sheet; and filling the hole with a transparent rubber-like elastic material coated with the transparent resin sheet by injecting the transparent rubber-like elastic material from an outer of the transparent resin sheet toward the hole to push a portion of the transparent resin sheet adjacent to the hole toward the opposite surface of the metal plate, wherein upon the hole being filled in with the transparent rubber-like elastic material, the pushed portion of the transparent resin sheet comprises at least an interior wall contact portion in contact with an interior wall of the hole and an exposing portion defining a ceiling of the hole adjacent to the opposite surface of the metal plate, the pushed portion of the transparent resin sheet forming an interior space containing the transparent rubber-like material surrounded by at least the wall contact portion and exposing portion of the transparent resin sheet within the gap.

9. A method of manufacturing a member for a push button switch according to claim 8, further comprising the step of forming a printing layer or a coloring layer at least in a portion extending toward a ceiling surface side of the metal push button in the transparent resin sheet.

10. A method of manufacturing a member for a push button switch according to claim 8, further comprising the step of making irregularities or a hole in the surface of the metal push button to form a number, a symbol, a pattern, or a graphic.

11. A method of manufacturing a member for a push button switch according to claim 8, further comprising the step of disposing a light emitting member between the surface opposite to the metal push button in the transparent rubber-like elastic material and a circuit board disposed therebelow.

12. A method of manufacturing a member for a push button switch according to claim 8, further comprising the step of forming a hole penetrating the metal push button in a direction into and out of the metal push button, wherein in the step of filling the hole with the transparent rubber-like elastic material, the transparent organic polymer material is made to extend from the hole to the ceiling surface side of the metal push button.

13. A method of manufacturing a member for a push button switch according to claim 8, further comprising the step of providing a sheet including a presser for pressing a switch below the transparent rubber-like elastic material.

14. A method of manufacturing a member for a push button switch according to claim 8, wherein in the step of filling the hole with the transparent rubber-like elastic material, the transparent organic polymer material is made to project from the surface of the metal push button.

15. A method of manufacturing a member for a push button switch having a configuration in which a gap between adjacent metal push buttons is filled with a transparent organic polymer material, the method comprising the steps of:

forming a concave portion by performing etching from one side of a metal plate to a halfway position of a thickness of the metal plate;

attaching a transparent resin sheet to the metal plate so as to close the concave portion of the one side;

forming a hole connected to the concave portion formed in advance by performing etching from a surface opposite to the surface where the transparent resin sheet is attached in the metal plate; and filling the hole with a transparent rubber-like elastic material coated with the transparent resin sheet by injecting the transparent rubber-like elastic material from an outer of the transparent resin sheet toward the hole to push a portion of the transparent resin sheet adjacent to the hole toward the opposite surface of the metal plate, wherein upon the hole being filled in with the transparent rubber-like elastic material, the pushed portion of the transparent resin sheet comprises at least an interior wall contact portion in contact with an interior wall of the hole and an exposing portion defining a ceiling of the hole adjacent to the opposite surface of the metal plate, the pushed portion of the transparent resin sheet forming an interior space containing the transparent rubber-like material surrounded by at least the wall contact portion and exposing portion of the transparent resin sheet within the gap.

16. A method of manufacturing a member for a push button switch according to claim 15, further comprising the step of forming a printing layer or a coloring layer at least in a portion extending toward a ceiling surface side of the metal push button in the transparent resin sheet.

17. A method of manufacturing a member for a push button switch according to claim 15, further comprising the step of making irregularities or a hole in the surface of the metal push button to form a number, a symbol, a pattern, or a graphic.

18. A method of manufacturing a member for a push button switch according to claim 15, further comprising the step of disposing a light emitting member between the surface opposite to the metal push button in the transparent rubber-like elastic material and a circuit board disposed therebelow.

19. A method of manufacturing a member for a push button switch according to claim 15, further comprising the step of forming a hole penetrating the metal push button in a direction into and out of the metal push button, wherein in the step of filling the hole with the transparent rubber-like elastic material, the transparent organic polymer material is made to extend from the hole to the ceiling surface side of the metal push button.

20. A method of manufacturing a member for a push button switch according to claim 15, further comprising the step of providing a sheet including a presser for pressing a switch below the transparent rubber-like elastic material.

21. A method of manufacturing a member for a push button switch according to claim 15, wherein in the step of filling the hole with the transparent rubber-like elastic material, the transparent organic polymer material is made to project from the surface of the metal push button.

* * * * *